US009672780B2

(12) United States Patent
Lee et al.

(10) Patent No.: US 9,672,780 B2
(45) Date of Patent: Jun. 6, 2017

(54) OVER DRIVE DATA GENERATOR AND DISPLAY DRIVER INCLUDING THE SAME

(71) Applicant: SAMSUNG ELECTRONICS CO., LTD., Suwon-si (KR)

(72) Inventors: Seung-woo Lee, Yongin-si (KR); Chiahsin Lin, Hsinchu (TW); Stanley Liao, Taoyuan (TW)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 26 days.

(21) Appl. No.: 14/702,231

(22) Filed: May 1, 2015

(65) Prior Publication Data

US 2015/0325217 A1 Nov. 12, 2015

(30) Foreign Application Priority Data

May 7, 2014 (KR) ..... 10-2014-0053933

(51) Int. Cl.
*G09G 3/36* (2006.01)

(52) U.S. Cl.
CPC ... *G09G 3/3648* (2013.01); *G09G 2320/0252* (2013.01); *G09G 2320/0285* (2013.01); *G09G 2340/16* (2013.01); *G09G 2360/12* (2013.01)

(58) Field of Classification Search
None
See application file for complete search history.

(56) References Cited

U.S. PATENT DOCUMENTS 6,452,579 B1 * 9/2002 Itoh ..... G09G 3/3648 345/100
7,362,173 B1 4/2008 Knausz
8,299,991 B2 10/2012 Boiko
8,350,793 B2 1/2013 Hung
8,384,636 B2 * 2/2013 Chiu ..... G09G 3/003 345/89
8,665,194 B2 * 3/2014 Liu ..... G09G 3/003 345/204
9,024,852 B2 * 5/2015 Ishihara ..... G09G 3/3611 345/87
9,035,867 B2 * 5/2015 Yoshida ..... G02F 1/136277 345/102
9,280,943 B2 * 3/2016 Kimpe ..... G09G 3/3648
(Continued)

FOREIGN PATENT DOCUMENTS

JP 2007-316380 A 12/2007
JP 5255186 B2 8/2013
(Continued)

*Primary Examiner* — Hilina K Demeter
(74) *Attorney, Agent, or Firm* — Sughrue Mion, PLLC

(57) ABSTRACT

A data generator includes an over drive data generator and a buffer. The over drive data generator generates an over drive data based on a previous display data and a current display data. The buffer provides the previous display data to the over drive data generator. The buffer stores the current display data and the over drive data. The buffer outputs the current display data and the over drive data. The data generator may increase the speed of driving the load connected to a display driver using the over drive voltage corresponding to the over drive data. If the speed of driving the load connected to the display driver is increased, the operational speed of the display device may be increased.

18 Claims, 22 Drawing Sheets

(56) References Cited

U.S. PATENT DOCUMENTS

2004/0012551 A1* 1/2004 Ishii ..... G09G 3/3406 345/87
2004/0100433 A1* 5/2004 Ham ..... G09G 3/3648 345/89
2004/0130559 A1* 7/2004 Lee ..... G09G 3/2011 345/690
2005/0068343 A1* 3/2005 Pan ..... G09G 3/3648 345/690
2005/0253833 A1* 11/2005 Teshirogi ..... G09G 3/3648 345/204
2008/0079673 A1* 4/2008 Liu ..... G09G 3/3648 345/87
2008/0225022 A1* 9/2008 Kim ..... G09G 3/3225 345/204
2008/0252668 A1* 10/2008 Chen ..... G09G 3/3648 345/690
2009/0079685 A1 3/2009 Sakai
2009/0153456 A1* 6/2009 Tsai ..... G09G 3/20 345/89
2009/0213050 A1* 8/2009 Hung ..... G09G 3/3611 345/87
2009/0237338 A1* 9/2009 Sumi ..... G09G 3/3611 345/89
2010/0302287 A1 12/2010 Katayama et al.
2011/0234649 A1* 9/2011 Ooishi ..... G09G 3/3648 345/690
2012/0154345 A1* 6/2012 Kim ..... G09G 3/3648 345/204
2012/0256975 A1 10/2012 Yukawa
2015/0371594 A1* 12/2015 Huang ..... G09G 3/003 345/690

FOREIGN PATENT DOCUMENTS

KR 10-2006-0131259 A 12/2006
KR 10-0783697 B1 12/2007
KR 10-2009-0067522 A 6/2009

* cited by examiner

FIG. 3

PREVIOUS DISPLAY DATA

CURRENT DISPLAY DATA

| | R1 | R2 | R3 | R4 | R5 | R6 | R7 | R8 | R9 | R10 | R11 | R12 | R13 | R14 | R15 | R16 |
|---|---|---|---|---|---|---|---|---|---|---|---|---|---|---|---|---|
| R1 | R1 | GND | GND | GND | GND | GND | GND | GND | GND | GND | GND | GND | GND | GND | GND | GND |
| R2 | R3 | R2 | R1 | R1 | R1 | R1 | R1 | R1 | R1 | R1 | R1 | R1 | R1 | R1 | R1 | R1 |
| R3 | R4 | R4 | R3 | R2 | R2 | R2 | R2 | R2 | R2 | R2 | R2 | R2 | R2 | R2 | R2 | R2 |
| R4 | R5 | R5 | R5 | R4 | R3 | R3 | R3 | R3 | R3 | R3 | R3 | R3 | R3 | R3 | R3 | R3 |
| R5 | R6 | R6 | R6 | R6 | R5 | R4 | R4 | R4 | R4 | R4 | R4 | R4 | R4 | R4 | R4 | R4 |
| R6 | R7 | R7 | R7 | R7 | R7 | R6 | R5 | R5 | R5 | R5 | R5 | R5 | R5 | R5 | R5 | R5 |
| R7 | R8 | R8 | R8 | R8 | R8 | R8 | R7 | R6 | R6 | R6 | R6 | R6 | R6 | R6 | R6 | R6 |
| R8 | R9 | R9 | R9 | R9 | R9 | R9 | R9 | R8 | R7 | R7 | R7 | R7 | R7 | R7 | R7 | R7 |
| R9 | R10 | R10 | R10 | R10 | R10 | R10 | R10 | R10 | R9 | R8 | R8 | R8 | R8 | R8 | R8 | R8 |
| R10 | R11 | R11 | R11 | R11 | R11 | R11 | R11 | R11 | R11 | R10 | R9 | R9 | R9 | R9 | R9 | R9 |
| R11 | R12 | R12 | R12 | R12 | R12 | R12 | R12 | R12 | R12 | R12 | R11 | R10 | R10 | R10 | R10 | R10 |
| R12 | R13 | R13 | R13 | R13 | R13 | R13 | R13 | R13 | R13 | R13 | R13 | R12 | R11 | R11 | R11 | R11 |
| R13 | R14 | R14 | R14 | R14 | R14 | R14 | R14 | R14 | R14 | R14 | R14 | R14 | R13 | R12 | R12 | R12 |
| R14 | R15 | R15 | R15 | R15 | R15 | R15 | R15 | R15 | R15 | R15 | R15 | R15 | R15 | R14 | R13 | R13 |
| R15 | R16 | R16 | R16 | R16 | R16 | R16 | R16 | R16 | R16 | R16 | R16 | R16 | R16 | R16 | R15 | R14 |
| R16 | VDD | VDD | VDD | VDD | VDD | VDD | VDD | VDD | VDD | VDD | VDD | VDD | VDD | VDD | VDD | R16 |

FIG. 7

PREVIOUS DISPLAY DATA

CURRENT DISPLAY DATA

| | R1 | R2 | R3 | R4 | R5 | R6 | R7 | R8 | R9 | R10 | R11 | R12 | R13 | R14 | R15 | R16 |
|---|---|---|---|---|---|---|---|---|---|---|---|---|---|---|---|---|
| R1 | X | GND | GND | GND | GND | GND | GND | GND | GND | GND | GND | GND | GND | GND | GND | GND |
| R2 | R3 | X | R1 | R1 | R1 | R1 | R1 | R1 | R1 | R1 | R1 | R1 | R1 | R1 | R1 | R1 |
| R3 | R4 | R4 | X | R2 | R2 | R2 | R2 | R2 | R2 | R2 | R2 | R2 | R2 | R2 | R2 | R2 |
| R4 | R5 | R5 | R5 | X | R3 | R3 | R3 | R3 | R3 | R3 | R3 | R3 | R3 | R3 | R3 | R3 |
| R5 | R6 | R6 | R6 | R6 | X | R4 | R4 | R4 | R4 | R4 | R4 | R4 | R4 | R4 | R4 | R4 |
| R6 | R7 | R7 | R7 | R7 | R7 | X | R5 | R5 | R5 | R5 | R5 | R5 | R5 | R5 | R5 | R5 |
| R7 | R8 | R8 | R8 | R8 | R8 | R8 | X | R6 | R6 | R6 | R6 | R6 | R6 | R6 | R6 | R6 |
| R8 | R9 | R9 | R9 | R9 | R9 | R9 | R9 | X | R7 | R7 | R7 | R7 | R7 | R7 | R7 | R7 |
| R9 | R10 | R10 | R10 | R10 | R10 | R10 | R10 | R10 | X | R8 | R8 | R8 | R8 | R8 | R8 | R8 |
| R10 | R11 | R11 | R11 | R11 | R11 | R11 | R11 | R11 | R11 | X | R9 | R9 | R9 | R9 | R9 | R9 |
| R11 | R12 | R12 | R12 | R12 | R12 | R12 | R12 | R12 | R12 | R12 | X | R10 | R10 | R10 | R10 | R10 |
| R12 | R13 | R13 | R13 | R13 | R13 | R13 | R13 | R13 | R13 | R13 | R13 | X | R11 | R11 | R11 | R11 |
| R13 | R14 | R14 | R14 | R14 | R14 | R14 | R14 | R14 | R14 | R14 | R14 | R14 | X | R12 | R12 | R12 |
| R14 | R15 | R15 | R15 | R15 | R15 | R15 | R15 | R15 | R15 | R15 | R15 | R15 | R15 | X | R13 | R13 |
| R15 | R16 | R16 | R16 | R16 | R16 | R16 | R16 | R16 | R16 | R16 | R16 | R16 | R16 | R16 | X | R14 |
| R16 | VDD | VDD | VDD | VDD | VDD | VDD | VDD | VDD | VDD | VDD | VDD | VDD | VDD | VDD | VDD | X |

FIG. 9

PREVIOUS DISPLAY DATA

CURRENT DISPLAY DATA

| | R1 | R2 | R3 | R4 | R5 | R6 | R7 | R8 | R9 | R10 | R11 | R12 | R13 | R14 | R15 | R16 |
|---|---|---|---|---|---|---|---|---|---|---|---|---|---|---|---|---|
| R1 | X | X | GND | GND | GND | GND | GND | GND | GND | GND | GND | GND | GND | GND | GND | GND |
| R2 | X | X | X | R1 | R1 | R1 | R1 | R1 | R1 | R1 | R1 | R1 | R1 | R1 | R1 | R1 |
| R3 | R4 | X | X | X | R2 | R2 | R2 | R2 | R2 | R2 | R2 | R2 | R2 | R2 | R2 | R2 |
| R4 | R5 | R5 | X | X | X | R3 | R3 | R3 | R3 | R3 | R3 | R3 | R3 | R3 | R3 | R3 |
| R5 | R6 | R6 | R6 | X | X | X | R4 | R4 | R4 | R4 | R4 | R4 | R4 | R4 | R4 | R4 |
| R6 | R7 | R7 | R7 | R7 | X | X | X | R5 | R5 | R5 | R5 | R5 | R5 | R5 | R5 | R5 |
| R7 | R8 | R8 | R8 | R8 | R8 | X | X | X | R6 | R6 | R6 | R6 | R6 | R6 | R6 | R6 |
| R8 | R9 | R9 | R9 | R9 | R9 | R9 | X | X | X | R7 | R7 | R7 | R7 | R7 | R7 | R7 |
| R9 | R10 | R10 | R10 | R10 | R10 | R10 | R10 | X | X | X | R8 | R8 | R8 | R8 | R8 | R8 |
| R10 | R11 | R11 | R11 | R11 | R11 | R11 | R11 | R11 | X | X | X | R9 | R9 | R9 | R9 | R9 |
| R11 | R12 | R12 | R12 | R12 | R12 | R12 | R12 | R12 | R12 | X | X | X | R10 | R10 | R10 | R10 |
| R12 | R13 | R13 | R13 | R13 | R13 | R13 | R13 | R13 | R13 | R13 | X | X | X | R11 | R11 | R11 |
| R13 | R14 | R14 | R14 | R14 | R14 | R14 | R14 | R14 | R14 | R14 | R14 | X | X | X | R12 | R12 |
| R14 | R15 | R15 | R15 | R15 | R15 | R15 | R15 | R15 | R15 | R15 | R15 | R15 | X | X | X | R13 |
| R15 | R16 | R16 | R16 | R16 | R16 | R16 | R16 | R16 | R16 | R16 | R16 | R16 | R16 | X | X | X |
| R16 | VDD | VDD | VDD | VDD | VDD | VDD | VDD | VDD | VDD | VDD | VDD | VDD | VDD | VDD | X | X |

OVER DRIVE DATA GENERATOR AND DISPLAY DRIVER INCLUDING THE SAME

CROSS-REFERENCE TO RELATED APPLICATION

This application claims priority from Korean Patent Application No. 10-2014-0053933, filed on May 7, 2014 in the Korean Intellectual Property Office (KIPO), the disclosure of which is herein incorporated by reference in its entirety.

BACKGROUND

1. Technical Field

Apparatuses and methods consistent with exemplary embodiments relate to a display device and more particularly to a data generator and a display driver including the data generator.

2. Description of the Related Art

According to development of electronic devices, a display device is being developed to have higher performance and higher speed. Especially researches about an ultra-high definition television are actively being done in connection with a resolution of the display device.

SUMMARY

One or more exemplary embodiments provide a data generator capable of increasing a driving speed of a display panel using an over drive voltage.

One or more exemplary embodiments provide a display driver capable of increasing a driving speed of a display panel using an over drive voltage.

According to an aspect of an exemplary embodiment, a data generator includes an over drive data generator and a buffer. The over drive data generator generates an over drive data based on a previous display data and a first current display data. The buffer provides a second current display data as the previous display data to the over drive data generator. The second current display data is received before the first current display data. The buffer stores the first current display data and the over drive data. The buffer outputs the first current display data and the over drive data.

The over drive data generator may include a look-up table. The look-up table may store the over drive data that is determined based on the previous display data and the first current display data. The over drive data corresponding to the previous display data and the first current display data may be determined based on the look-up table.

In the case the first current display data is greater than the previous display data, the over drive data may be greater than the first current display data.

In the case the first current display data is equal to the previous display data, the over drive data may be equal to the first current display data.

In the case the first current display data is less than the previous display data, the over drive data may be less than the first current display data.

Each of the first current display data and the previous display data may be one level-value of a plurality of level-values. In the case the first current display data is equal to the previous display data, the over drive data generator may stop providing the over drive data.

Each of the first current display data and the previous display data may be one level-value of a plurality of level-values. In the case a difference value between the first current display data and the previous display data is a unit level-value corresponding to a difference value among the plurality of level-values, the over drive data generator may stop providing the over drive data.

According to an aspect of an exemplary embodiment, a display driver includes an over drive time register, a data generator and an analog unit. The over drive time register stores an over drive time. The data generator provides a first current display data and an over drive data. The analog unit provides a current display voltage corresponding to the first current display data and an over drive voltage corresponding to the over drive data based on the over drive time, the first current display data and the over drive data. The data generator includes an over drive data generator and a buffer. The over drive data generator generates the over drive data based on a previous display data and a first current display data. The buffer provides a second current display data as the previous display data to the over drive data generator. The second current display data is received before the first current display data. The buffer stores the first current display data and the over drive data. The buffer outputs the first current display data and the over drive data.

The analog unit may include a source channel unit and a gamma unit. The source channel unit may provide the first current display data and the over drive data. The source channel unit may provide the current display voltage and the over drive voltage based on the over drive time. The gamma unit may provide the current display voltage and the over drive voltage to the source channel unit. The current display voltage may correspond to the first current display data from the source channel unit. The over drive voltage may correspond to the over drive data from the source channel unit.

The source channel unit may include a storage unit and an output unit. The storage unit may store the first current display data and the over drive data. The output unit may provide the current display voltage and the over drive voltage based on the over drive time.

The storage unit may provide the over drive data during a time-interval corresponding to the over drive time.

The storage unit may provide the first current display data during a time-interval corresponding to a display time.

A sum of a time-interval corresponding to the over drive time and the time-interval corresponding to the display time may be constant.

A transition time of a load unit may be changed based on the over drive time. The load unit may receive the current display voltage and the over drive voltage from the source channel unit.

A transition time of a load unit may be changed based on the over drive data. The load unit may receive the current display voltage and the over drive voltage from the source channel unit.

A highest voltage of the current display voltage may be less than a highest voltage of the over drive voltage. A lowest voltage of the current display voltage is greater than a lowest voltage of the over drive voltage.

BRIEF DESCRIPTION OF THE DRAWINGS

The above and/or other aspects will become more apparent by describing certain exemplary embodiments, with reference to the accompanying drawings, in which:

FIG. 3 is a diagram illustrating an example of a look-up table included in the data generator of FIG. 1.

FIG. 7 is a diagram illustrating an example of a look-up table included in the data generator of FIG. 1.

FIG. 9 is a diagram illustrating an example of a look-up table included in the data generator of FIG. 1.

DETAILED DESCRIPTION OF EXEMPLARY EMBODIMENTS

Figure 1:
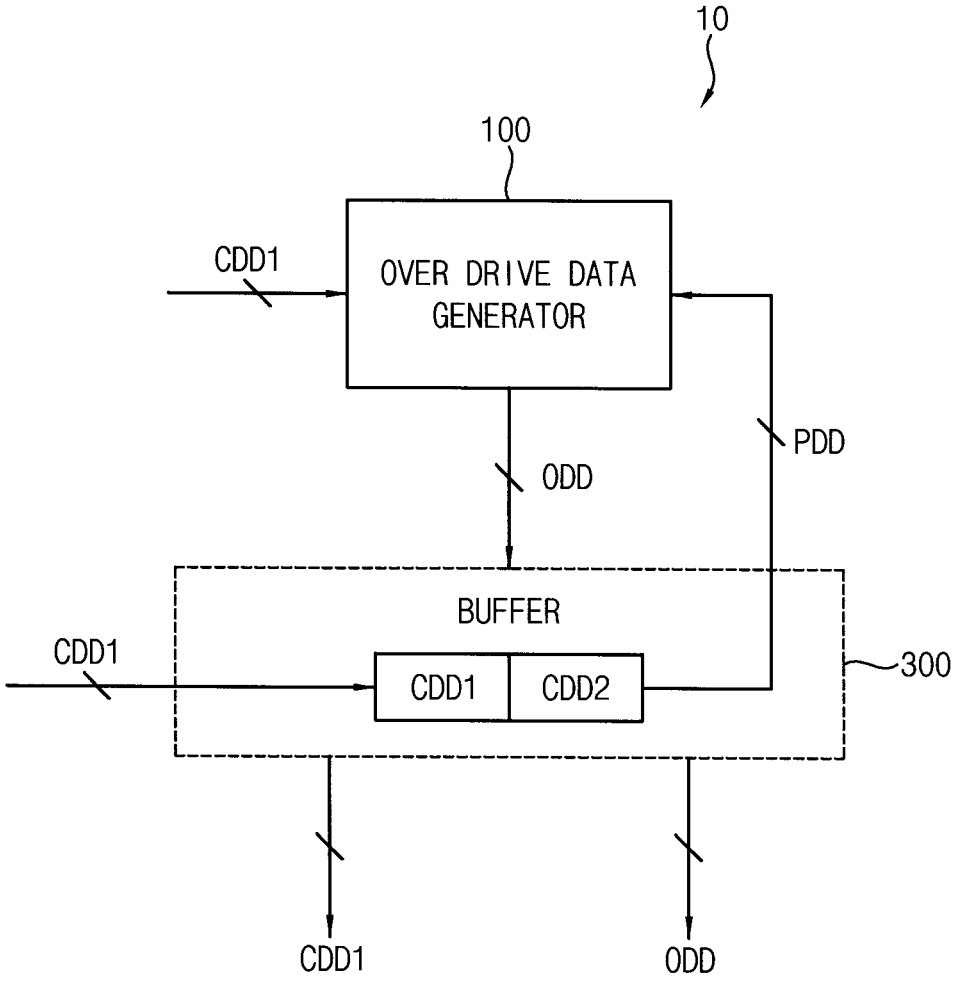
FIG. 1 is a block diagram illustrating a data generator according to exemplary embodiments.

Certain exemplary embodiments are described in greater detail below with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions are not described in detail since they would obscure the description with unnecessary detail.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
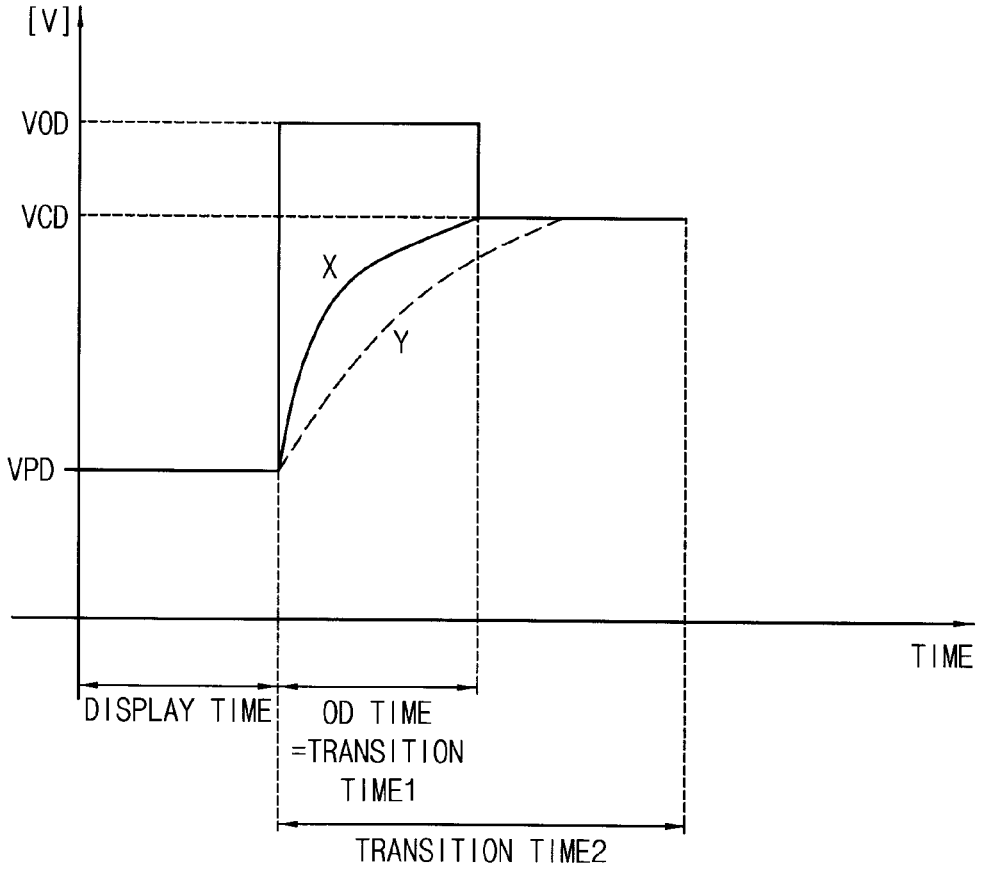
FIG. 2 is a timing diagram for describing an operation of a display driver including the data generator of FIG. 1.

FIG. 1 is a block diagram illustrating a data generator according to exemplary embodiments and FIG. 2 is a timing diagram for describing an operation of a display driver including the data generator of FIG. 1.

Referring to FIGS. 1 and 2, a data generator 10 includes an over drive data generator 100 and a buffer 300, e.g., a memory. The over drive data generator 100 generates an over drive data ODD based on a previous display data PDD and a first current display data CDD1.

A previous display voltage VPD may be a voltage corresponding to the previous display data PDD. A current display voltage VCD may be a voltage corresponding to the first current display data CDD1. An over drive voltage VOD may be a voltage corresponding to the over drive data ODD. An over drive time ODT may be a time interval of applying the over drive voltage VOD. The over drive voltage VOD may be used to drive a load connected to a display driver.

For example, a voltage of the load connected to the display driver may be maintained as the previous display voltage VPD corresponding to the previous display data PDD during a display time DT. After that, to increase a voltage from the previous display voltage VPD to the current display voltage VCD corresponding to the first current display data CDD1, a transition time TT from the previous display voltage VPD to the current display voltage VCD may be required. In the case the voltage applied to the load during the transition time TT is the over drive voltage VOD corresponding to the over drive data ODD, a transition curve may be an X curve and a transition interval may be a first transition time TT1.

In the case the voltage applied to the load during the transition time TT is the current display voltage VCD, a transition curve may be a Y curve and a transition interval may be a second transition time TT2. The first transition time TT1 may be less than the second transition time TT2. If the load connected to the display driver is driven using the over drive voltage VOD, an operation speed of a display device may be increased.

The buffer 300 provides a second current display data CDD2 as the previous display data PDD to the over drive data generator 100. The second current display data CDD2 is received before the first current display data CDD1. The buffer 300 stores the first current display data CDD1 and the over drive data ODD. The buffer 300 outputs the first current display data CDD1 and the over drive data ODD. The current display data CDD may be sequentially transferred to the buffer 300. For example, in the beginning, the current display data CDD transferred to the buffer 300 may be a second current display data CDD2. Next, the following current display data CDD transferred to the buffer 300 may be a first current display data CDD1. The second current display data CDD2 may be stored in the buffer 300 and the first current display data CDD1 may be transferred to the over drive data generator 100. If the first current display data CDD1 is transferred to the over drive data generator 100, the second current display data CDD2 stored in the buffer 300 may be provided as the previous display data PDD to the over drive data generator 100.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

FIG. 3 is a diagram illustrating an example of a look-up table included in the data generator of FIG. 1.

Referring to FIGS. 1 to 3, the over drive data generator 100 may include a look-up table. The look-up table may store the over drive data ODD that is determined based on the previous display data PDD and the first current display data CDD1.

The first current display data CDD1 and the previous display data PDD may be one of a plurality of level-values. For example, the first current display data CDD1 and the previous display data PDD may be one of R1 to R16. The over drive data ODD may be one of a plurality of level-values. For example, the over drive data ODD may be one of GND, R1 to R16 and VDD. For example, the GND may refer to a ground voltage value, e.g., 0V, VDD may refer to a supply voltage value, e.g., 5 VDC, 12 VDC, 24 VDC, etc., and values of R1 to R16 may refer to voltage values in a range from the GND to VDD.

The over drive data generator 100 may determine the over drive data ODD corresponding to the first current display data CDD1 and the previous display data PDD based on the look-up table.

For example, in the case the first current display data CDD1 is R1 and the previous display data PDD is R1, the over drive data ODD corresponding to the first current display data CDD1 and the previous display data PDD may be R1. In the case the first current display data CDD1 is R1 and the previous display data PDD is R2 to R16, the over drive data ODD corresponding to the first current display data CDD1 and the previous display data PDD may be GND.

For example, in the case the first current display data CDD1 is R8 and the previous display data PDD is R1 to R7, the over drive data ODD corresponding to the first current display data CDD1 and the previous display data PDD may be R9. In the case the first current display data CDD1 is R8 and the previous display data PDD is R8, the over drive data ODD corresponding to the first current display data CDD1 and the previous display data PDD may be R8. In the case the first current display data CDD1 is R8 and the previous display data PDD is R9 to R16, the over drive data ODD corresponding to the first current display data CDD1 and the previous display data PDD may be R7.

For example, in the case the first current display data CDD1 is R16 and the previous display data PDD is R1 to R15, the over drive data ODD corresponding to the first current display data CDD1 and the previous display data PDD may be VDD. In the case the first current display data CDD1 is R16 and the previous display data PDD is R16, the over drive data ODD corresponding to the first current display data CDD1 and the previous display data PDD may be R16.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Figure 4:
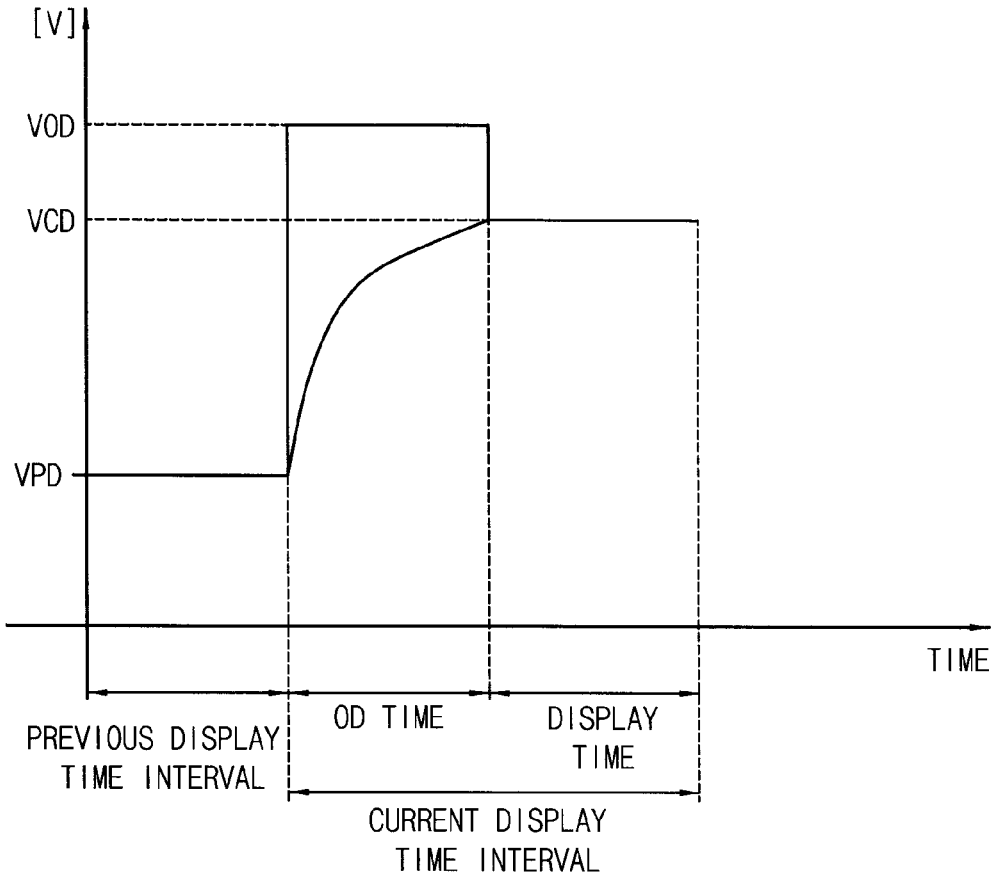
FIGS. 4, 5 and 6 are diagrams illustrating operation examples of a display driver including the data generator of FIG. 1.
Figure 5:
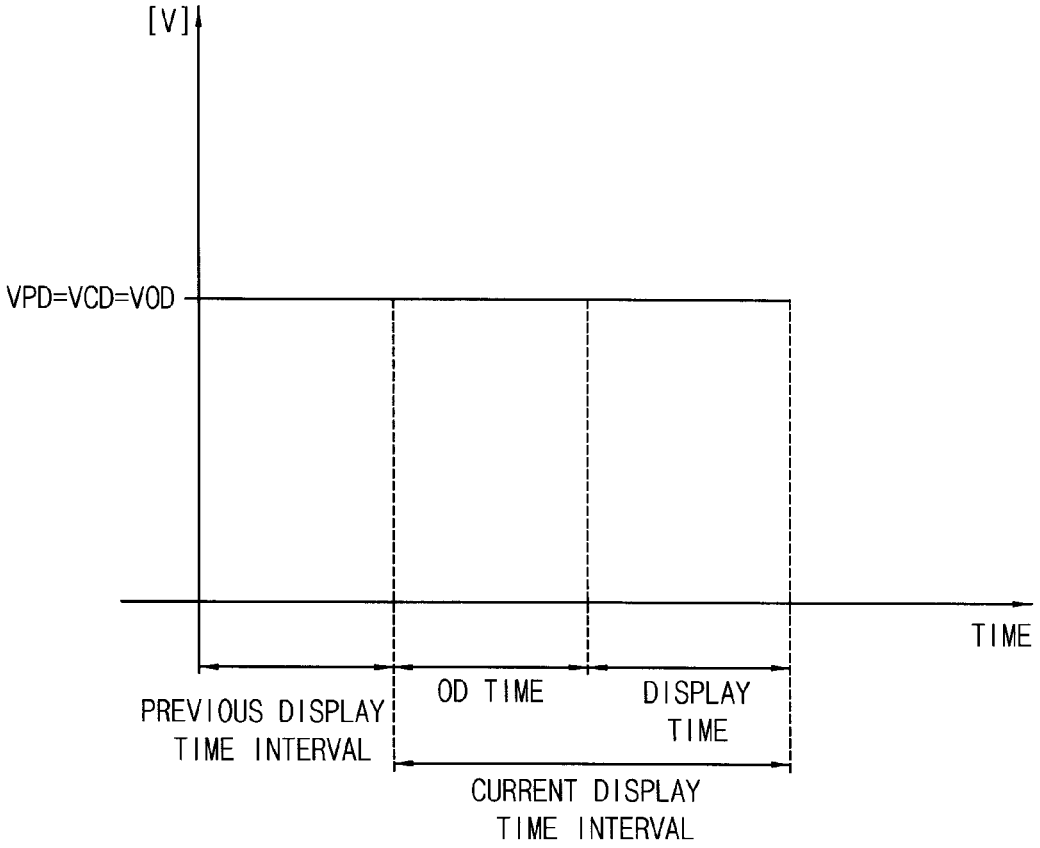
Figure 6:
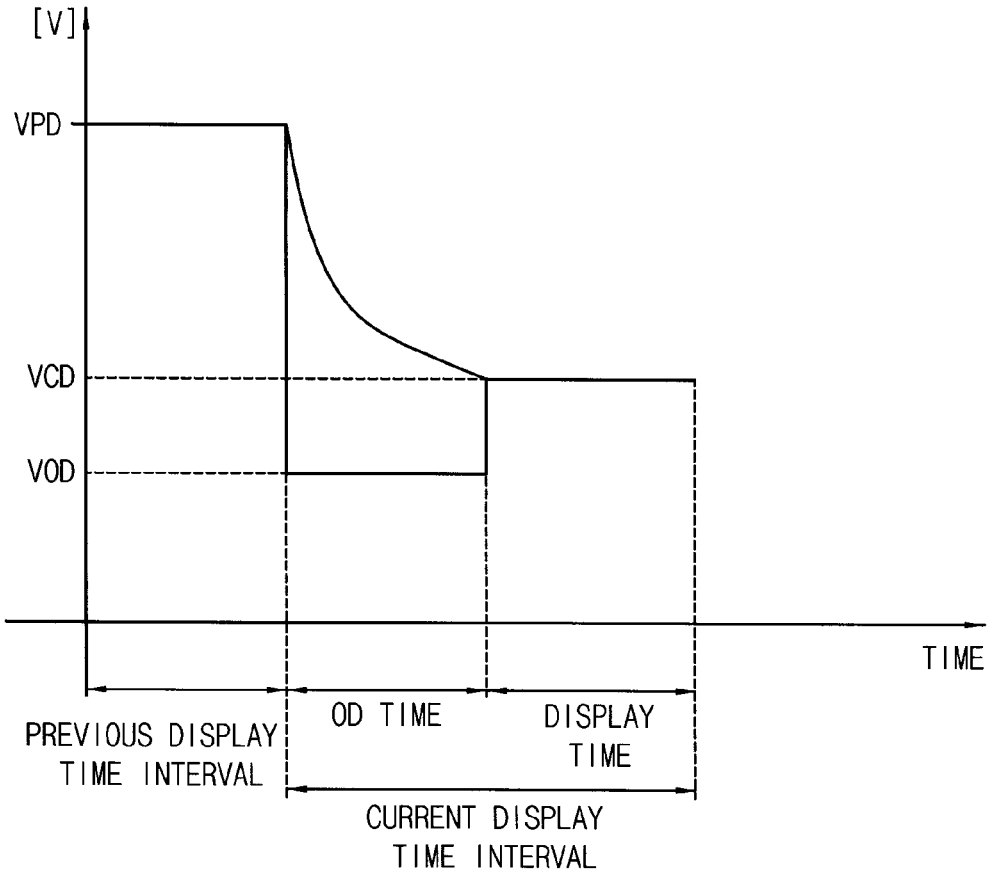

FIGS. 4, 5 and 6 are diagrams illustrating operation examples of a display driver including the data generator of FIG. 1.

Referring to FIGS. 3 and 4, in the case the first current display data CDD1 is greater than the previous display data PDD, the over drive data ODD may be greater than the first current display data CDD1.

The previous display voltage VPD may be the voltage corresponding to the previous display data PDD. The current display voltage VCD may be the voltage corresponding to the first current display data CDD1. The over drive voltage VOD may be the voltage corresponding to the over drive data ODD. The over drive time ODT may be the time interval of applying the over drive voltage VOD. The over drive voltage VOD may be used to drive the load connected to the display driver.

In the case the current display voltage VCD corresponding to the first current display data CDD1 is greater than the previous display voltage VPD corresponding to the previous display data PDD, the over drive voltage VOD may be greater than the current display voltage VCD. A current display time interval CDTI may include an over drive time ODT and a display time DT.

For example, after the previous display voltage VPD is applied to the load connected to the display driver during a previous display time interval PDTI, the over drive voltage VOD greater than the current display voltage VCD may be applied to the load during the over drive time ODT so that the voltage of the load maintains the current display voltage VCD during the display time DT included in the current display time interval CDTI.

For example, if the over drive voltage VOD that is the same as the current display voltage VCD is applied to the load during the over drive time ODT, the transition time TT from the previous display voltage VPD to the current display voltage VCD may be increased. Therefore, the voltage of the load does not maintain the current display voltage VCD during the display time DT included in the current display time interval CDTI.

For example, if the over drive voltage VOD that is less than the current display voltage VCD is applied to the load during the over drive time ODT, the transition time TT from the previous display voltage VPD to the current display voltage VCD may be further increased. Therefore, the voltage of the load does not maintain the current display voltage VCD during the display time DT included in the current display time interval CDTI. The first current display data CDD1 and the previous display data PDD may be one of the plurality of level-values For example, the first current display data CDD1 and the previous display data PDD may be one of R1 to R16. The over drive data ODD may be one of the plurality of level-values. For example, the over drive data ODD may be one of GND, R1 to R16 and VDD.

For example, in the case the first current display data CDD1 is sequentially increased from R1 to R16, the current display voltage VCD corresponding to the first current display data CDD1 may be sequentially increased. In other words, the current display voltage VCD corresponding to R1 may be less than the current display voltage VCD corresponding to R2.

In the case the previous display data PDD is sequentially increased from R1 to R16, the previous display voltage VPD corresponding to the previous display data PDD may be sequentially increased. In other words, the previous display voltage VPD corresponding to R1 may be less than the previous display voltage VPD corresponding to R2.

For example, in the case the over drive data ODD is sequentially increased from R1 to R16, the over drive voltage VOD corresponding to the over drive data ODD may be sequentially increased. In other words, the over drive voltage VOD corresponding to R1 may be less than the over drive voltage VOD corresponding to R2. Also, the over drive voltage VOD corresponding to GND may be less than the over drive voltage VOD corresponding to R1. The over drive voltage VOD corresponding to VDD may be greater than the over drive voltage VOD corresponding to R16.

For example, in the case the first current display data CDD1 is R8 and the previous display data PDD is R1 to R7, the over drive data ODD corresponding to the first current display data CDD1 and the previous display data PDD may be R9. In this case, the first current display data CDD1 may be greater than the previous display data PDD. The over drive data ODD may be greater than the first current display data CDD1.

For example, in the case the first current display data CDD1 is R8 and the previous display data PDD is R1 to R7, the current display voltage VCD corresponding to the first current display data CDD1 may be higher than the previous display voltage VPD corresponding to the previous display data PDD. If the current display voltage VCD is higher than the previous display voltage VPD, the over drive voltage VOD may be higher than the current display voltage VCD. If the over driver voltage is applied to the load connected to the display driver during the over drive time ODT, the operation speed of the display device may be increased.

Referring to FIGS. 3 and 5, in the case the first current display data CDD1 is equal to the previous display data PDD, the over drive data ODD may be equal to the first current display data CDD1.

In the case the current display voltage VCD corresponding to the first current display data CDD1 is equal to the previous display voltage VPD corresponding to the previous display data PDD, the over drive voltage VOD may be equal to the current display voltage VCD. The current display time interval CDTI may include the over drive time ODT and the display time DT.

For example, after the previous display voltage VPD is applied to the load connected to the display driver during a previous display time interval PDTI, the over drive voltage VOD that is equal to the current display voltage VCD may be applied to the load during the over drive time ODT so that the voltage of the load maintains the current display voltage VCD for the display time DT included in the current display time interval CDTI.

For example, in the case the first current display data CDD1 is R1 and the previous display data PDD is R1, the over drive data ODD corresponding to the first current display data CDD1 and the previous display data PDD may be R1. In the case the first current display data CDD1 is R8 and the previous display data PDD is R8, the over drive data ODD corresponding to the first current display data CDD1 and the previous display data PDD may be R8. In the case the first current display data CDD1 is R16 and the previous display data PDD is R16, the over drive data ODD corresponding to the first current display data CDD1 and the previous display data PDD may be R16. In this case, the first current display data CDD1 may be equal to the previous display data PDD. The over drive data ODD may be the first current display data CDD1.

For example, in the case the first current display data CDD1 is R1 and the previous display data PDD is R1, the current display voltage VCD corresponding to the first current display data CDD1 may be equal to the previous display voltage VPD corresponding to the previous display data PDD. If the current display voltage VCD is equal to the previous display voltage VPD, the over drive voltage VOD may be equal to the current display voltage VCD.

Referring to FIGS. 3 and 6, in the case the first current display data CDD1 is less than the previous display data PDD, the over drive data ODD may be less than the first current display data CDD1.

In the case the current display voltage VCD corresponding to the first current display data CDD1 is less than the previous display voltage VPD corresponding to the previous display data PDD, the over drive voltage VOD may be less than the current display voltage VCD. The current display time interval CDTI may include an over drive time ODT and a display time DT.

For example, after the previous display voltage VPD is applied to the load connected to the display driver during the previous display time interval PDTI, the over drive voltage VOD less than the current display voltage VCD may be applied to the load during the over drive time ODT so that the voltage of the load maintains the current display voltage VCD during the display time DT included in the current display time interval CDTI.

For example, if the over drive voltage VOD that is the same as the current display voltage VCD is applied to the load during the over drive time ODT, the transition time TT from the previous display voltage VPD to the current display voltage VCD may be increased. Therefore, the voltage of the load does not maintain the current display voltage VCD during the display time DT included in the current display time interval CDTI.

For example, if the over drive voltage VOD that is greater than the current display voltage VCD is applied to the load during the over drive time ODT, the transition time TT from the previous display voltage VPD to the current display voltage VCD may be further increased. Therefore, the voltage of the load does not maintain the current display voltage VCD during the display time DT included in the current display time interval CDTI.

For example, in the case the first current display data CDD1 is R8 and the previous display data PDD is R9 to R16, the over drive data ODD corresponding to the first current display data CDD1 and the previous display data PDD may be R7. In this case, the first current display data CDD1 may be less than the previous display data PDD. The over drive data ODD may be less than the first current display data CDD1.

For example, in the case the first current display data CDD1 is R8 and the previous display data PDD is R9 to R16, the current display voltage VCD corresponding to the first current display data CDD1 may be lower than the previous display voltage VPD corresponding to the previous display data PDD. If the current display voltage VCD is lower than the previous display voltage VPD, the over drive voltage VOD may be lower than the current display voltage VCD. If the over driver voltage is applied to the load connected to the display driver during the over drive time ODT, the operation speed of the display device may be increased.

Figure 8:
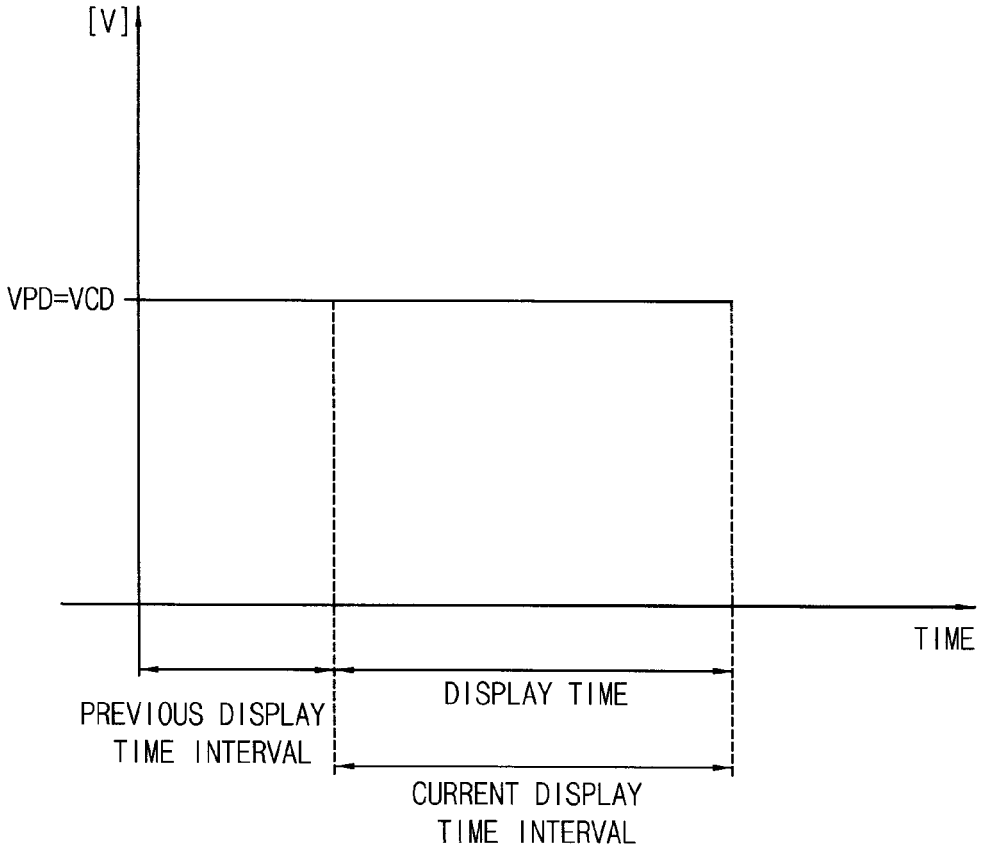
FIG. 8 is a diagram illustrating an operation example of a display driver including the data generator of FIG. 1.

FIG. 7 is a diagram illustrating another example of a look-up table included in the data generator of FIG. 1 and FIG. 8 is a diagram illustrating another operation example of a display driver including the data generator of FIG. 1.

Referring to FIGS. 1 and 7, the first current display data CDD1 and the previous display data PDD may be one of the plurality of level-values. For example, the first current display data CDD1 and the previous display data PDD may be one of R1 to R16. The over drive data ODD may be one of a plurality of level-values. For example, the over drive data ODD may be one of GND, R1 to R16 and VDD.

The over drive data generator 100 may determine the over drive data ODD corresponding to the first current display data CDD1 and the previous display data PDD based on the look-up table.

For example, in the case the first current display data CDD1 is R1 and the previous display data PDD is R1, the over drive data ODD corresponding to the first current display data CDD1 and the previous display data PDD is not generated. In the case the first current display data CDD1 is R1 and the previous display data PDD is R2 to R16, the over drive data ODD corresponding to the first current display data CDD1 and the previous display data PDD may be GND.

For example, in the case the first current display data CDD1 is R8 and the previous display data PDD is R1 to R7, the over drive data ODD corresponding to the first current display data CDD1 and the previous display data PDD may be R9. In the case the first current display data CDD1 is R8 and the previous display data PDD is R8, the over drive data ODD corresponding to the first current display data CDD1 and the previous display data PDD is not generated. In the case the first current display data CDD1 is R8 and the previous display data PDD is R9 to R16, the over drive data ODD corresponding to the first current display data CDD1 and the previous display data PDD may be R7.

For example, in the case the first current display data CDD1 is R16 and the previous display data PDD is R1 to R15, the over drive data ODD corresponding to the first current display data CDD1 and the previous display data PDD may be VDD. In the case the first current display data CDD1 is R16 and the previous display data PDD is R16, the over drive data ODD corresponding to the first current display data CDD1 and the previous display data PDD is not generated.

Referring to FIGS. 7 and 8, each of the first current display data CDD1 and the previous display data PDD may be one level-value of a plurality of level-values. In the case the first current display data CDD1 is equal to the previous display data PDD, the over drive data generator 100 may stop providing the over drive data ODD.

In the case the current display voltage VCD corresponding to the first current display data CDD1 is equal to the previous display voltage VPD corresponding to the previous display data PDD, the over drive voltage VOD is not provided. The current display time interval CDTI may include the display time DT. The current display time interval CDTI does not include the over drive time ODT. Because the previous display voltage VPD applied to the load during the previous display time interval PDTI is equal to the current display voltage VCD applied to the load during the current display time interval CDTI, the over drive voltage VOD is not needed.

For example, in the case the first current display data CDD1 is R1 and the previous display data PDD is R1, the current display voltage VCD corresponding to the first current display data CDD1 may be equal to the previous display voltage VPD corresponding to the previous display data PDD. If the current display voltage VCD is equal to the previous display voltage VPD, the over drive voltage VOD is not provided.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Figure 10:
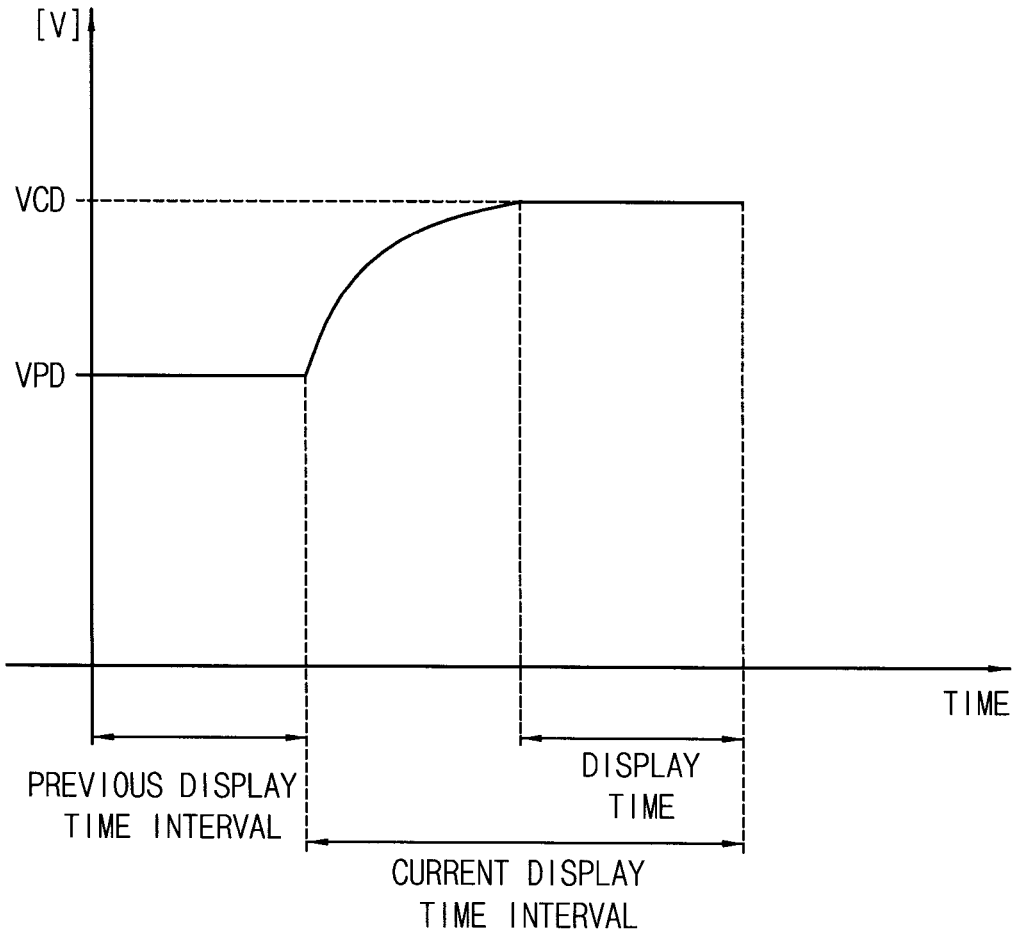
FIGS. 10 and 11 are diagrams illustrating still an operation example of a display driver including the data generator of FIG. 1.
Figure 11:
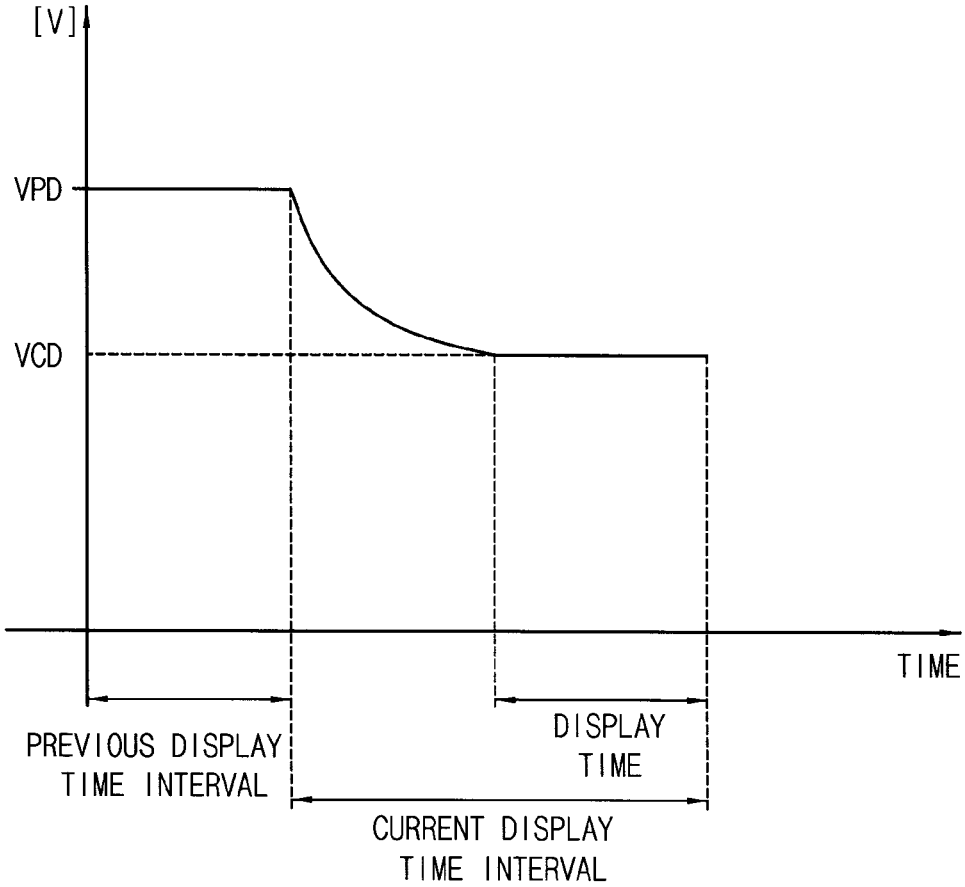

FIG. 9 is a diagram illustrating still another example of a look-up table included in the data generator of FIG. 1 and FIGS. 10 and 11 are diagrams illustrating still another operation example of a display driver including the data generator of FIG. 1.

Referring to FIGS. 1 and 9, the first current display data CDD1 and the previous display data PDD may be one of a plurality of level-values. For example, the first current display data CDD1 and the previous display data PDD may be one of R1 to R16. The over drive data ODD may be one of a plurality of level-values. For example, the over drive data ODD may be one of GND, R1 to R16 and VDD.

For example, in the case the first current display data CDD1 is R1 and the previous display data PDD is R1 or R2, the over drive data ODD corresponding to the first current display data CDD1 and the previous display data PDD is not generated. In the case the first current display data CDD1 is R1 and the previous display data PDD is R3 to R16, the over drive data ODD corresponding to the first current display data CDD1 and the previous display data PDD may be GND.

For example, in the case the first current display data CDD1 is R8 and the previous display data PDD is R1 to R6, the over drive data ODD corresponding to the first current display data CDD1 and the previous display data PDD may be R9. In the case the first current display data CDD1 is R8 and the previous display data PDD is R7, R8 or R9, the over drive data ODD corresponding to the first current display data CDD1 and the previous display data PDD is not generated. In the case the first current display data CDD1 is R8 and the previous display data PDD is R10 to R16, the over drive data ODD corresponding to the first current display data CDD1 and the previous display data PDD may be R7.

For example, in the case the first current display data CDD1 is R16 and the previous display data PDD is R1 to R14, the over drive data ODD corresponding to the first current display data CDD1 and the previous display data PDD may be VDD. In the case the first current display data CDD1 is R16 and the previous display data PDD is R15 or R16, the over drive data ODD corresponding to the first current display data CDD1 and the previous display data PDD is not generated.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Referring to FIGS. 9, 10, and 11, each of the first current display data CDD1 and the previous display data PDD may be one level-value of a plurality of level-values. In the case a difference value between the first current display data CDD1 and the previous display data PDD is a unit level-value corresponding to a difference value among the plurality of level-values, the over drive data generator 100 may stop providing the over drive data ODD.

For example, in the case the first current display data CDD1 is R1 and the previous display data PDD is R2, the difference value between the first current display data CDD1 and the previous display data PDD may be the unit level-value corresponding to the difference value among the plurality of level-values. In this case, over drive data generator 100 may stop providing the over drive data ODD.

For example, in the case the first current display data CDD1 is R8 and the previous display data PDD is R7 or R9, the difference value between the first current display data CDD1 and the previous display data PDD may be the unit level-value corresponding to the difference value among the plurality of level-values. In this case, over drive data generator 100 may stop providing the over drive data ODD.

For example, in the case the first current display data CDD1 is R16 and the previous display data PDD is R15, the difference value between the first current display data CDD1 and the previous display data PDD may be the unit level-value corresponding to the difference value among the plurality of level-values. In this case, over drive data generator 100 may stop providing the over drive data ODD.

In the case the difference value between the first current display data CDD1 and the previous display data PDD is the unit level-value corresponding to the difference value among the plurality of level-values, an over drive time register 500 may be set by a value corresponding to the over drive time ODT as will be described referring to FIG. 12.

For example, after the previous display voltage VPD is applied to the load connected to the display driver during a previous display time interval PDTI, the current display voltage VCD may be applied to the load during the current display time interval CDTI so that the voltage of the load maintains the current display voltage VCD during the display time DT included in the current display time interval CDTI. In this case, the over drive time ODT may be 0.

In the case a difference value between the first current display data CDD1 and the previous display data PDD is a unit level-value corresponding to a difference value among the plurality of level-values, the difference voltage between the previous display voltage VPD and the current display voltage VCD may be very small. In this case, the difference between the transition time TT in the case of applying the over drive voltage VOD to the load and the transition time TT in the case of not applying the over drive voltage VOD to the load may be very small. Therefore, in the case the difference value between the first current display data CDD1 and the previous display data PDD is the unit level-value corresponding to the difference value among the plurality of level-values, the over drive voltage VOD is not used.

Figure 12:
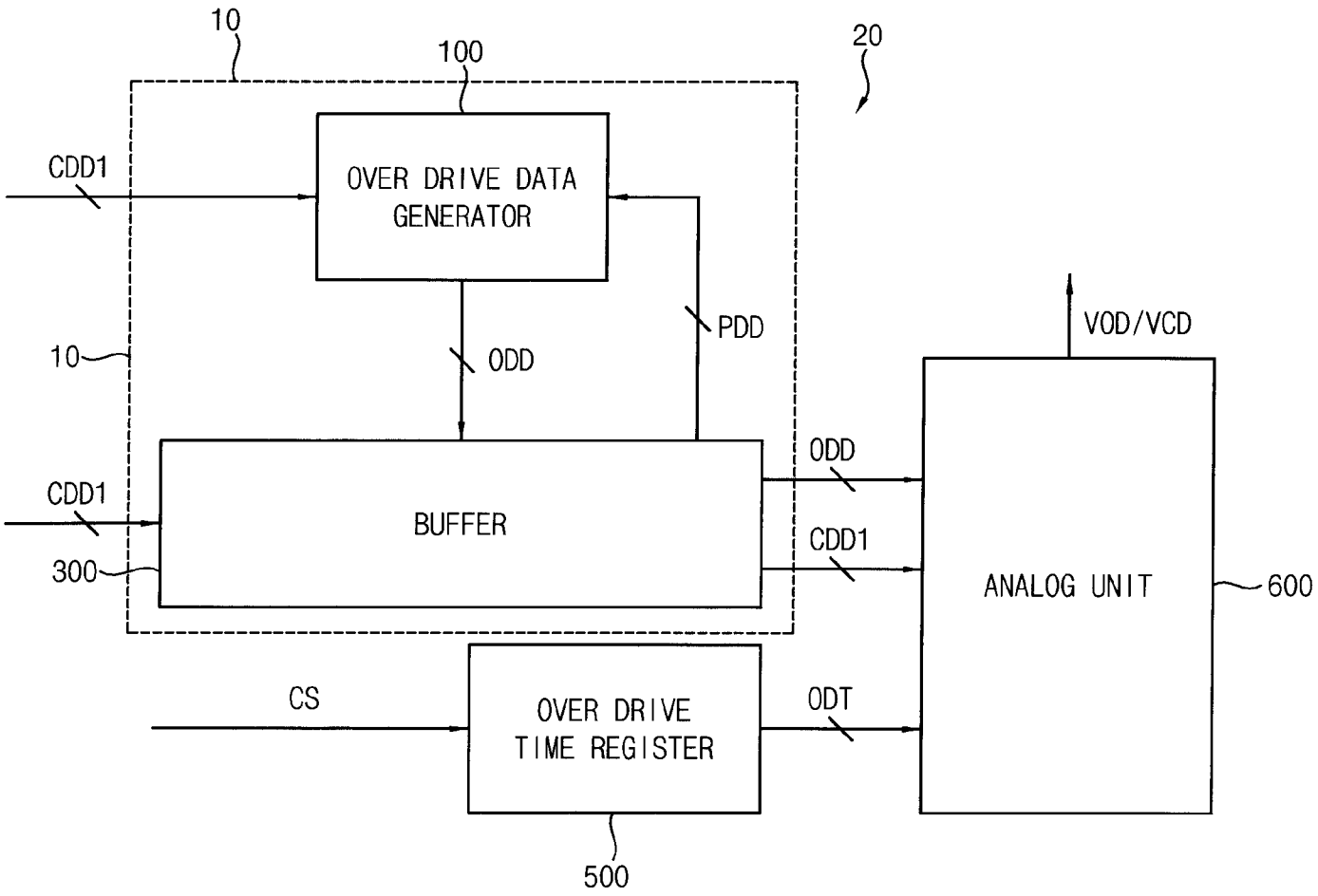
FIG. 12 is a block diagram illustrating a display driver according to exemplary embodiments.

FIG. 12 is a block diagram illustrating a display driver according to exemplary embodiments.

Referring to FIGS. 1 and 12, a display driver includes an over drive time register 500, a data generator 10 and an analog unit 600. The over drive time register 500 stores an over drive time ODT. A value of the over drive register may be changed by controlling the over drive time register 500 according to a control signal CS. The value of the over drive time register 500 may be the over drive time ODT. The data generator 10 provides a first current display data CDD1 and an over drive data ODD. The analog unit 600 provides a current display voltage VCD corresponding to the first current display data CDD1 and an over drive voltage VOD corresponding to the over drive data ODD based on the over drive time ODT, the first current display data CDD1 and the over drive data ODD.

The data generator 10 includes an over drive data generator 100 and a buffer 300. The over drive data generator 100 generates the over drive data ODD based on a previous display data PDD and a first current display data CDD1. The buffer 300 provides a second current display data CDD2 as the previous display data PDD to the over drive data generator 100. The second current display data CDD2 is received before the first current display data CDD1. The buffer 300 stores the first current display data CDD1 and the over drive data ODD. The buffer 300 outputs the first current display data CDD1 and the over drive data ODD.

A previous display voltage VPD may be a voltage corresponding to the previous display data PDD. A current display voltage VCD may be a voltage corresponding to the first current display data CDD1. An over drive voltage VOD may be a voltage corresponding to the over drive data ODD. An over drive time ODT may be a time interval of applying the over drive voltage VOD. The over drive voltage VOD may be used to drive a load connected to a display driver.

The current display data CDD may be sequentially transferred to the buffer 300. For example, in the beginning, the current display data CDD transferred to the buffer 300 may be a second current display data CDD2. Next, the following current display data CDD transferred to the buffer 300 may be a first current display data CDD1. The second current display data CDD2 may be stored in the buffer 300 and the first current display data CDD1 may be transferred to the over drive data generator 100. If the first current display data CDD1 is transferred to the over drive data generator 100, the second current display data CDD2 stored in the buffer 300 may be provided as the previous display data PDD to the over drive data generator 100.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Figure 13:
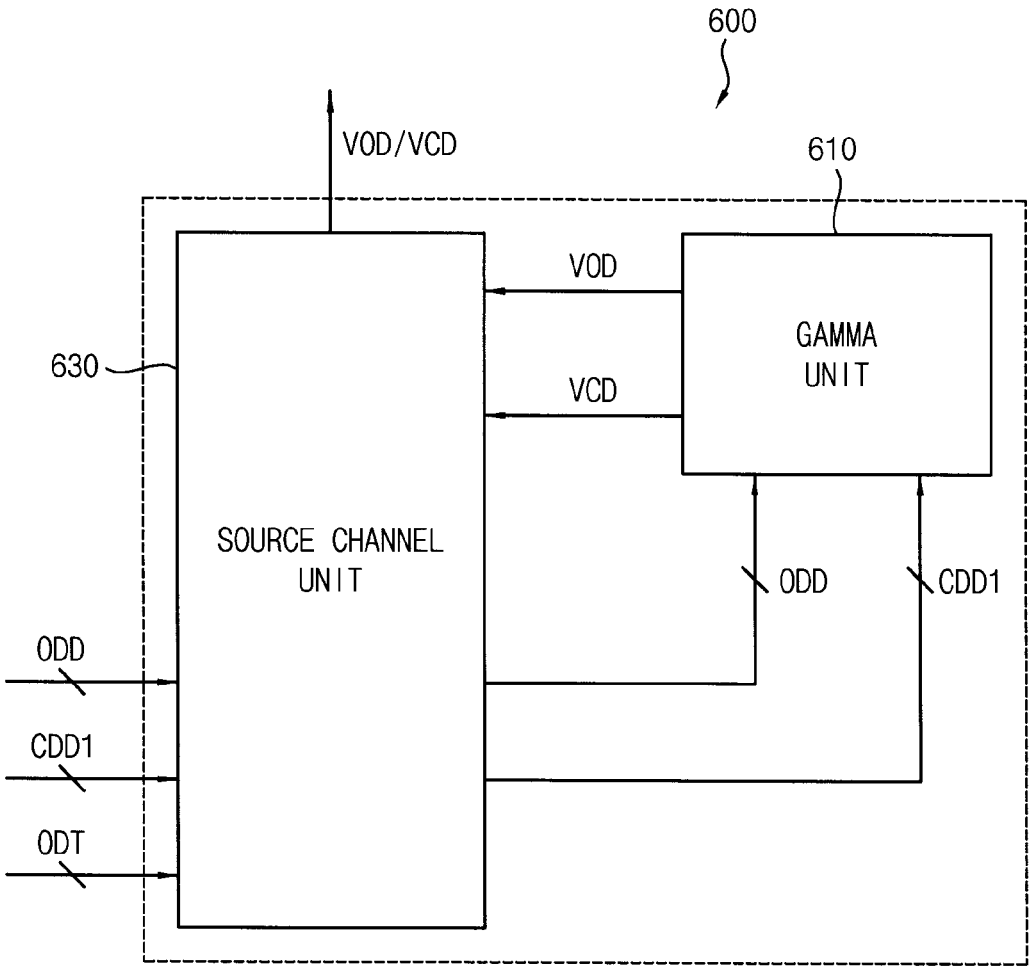
FIG. 13 is a block diagram illustrating an example of an analog unit included in the display driver of FIG. 12.
Figure 14:
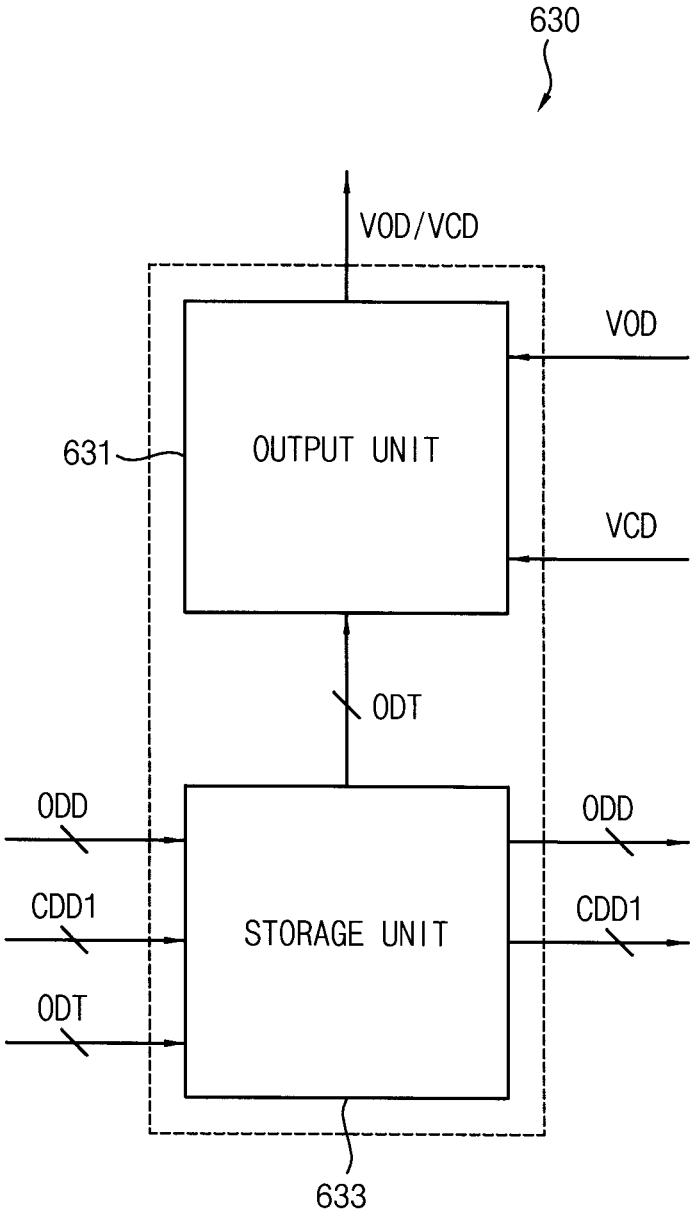
FIG. 14 is a block diagram illustrating an example of a source channel unit included in the analog unit of FIG. 13.

FIG. 13 is a block diagram illustrating an example of an analog unit included in the display driver of FIG. 12 and FIG. 14 is a block diagram illustrating an example of a source channel unit included in the analog unit of FIG. 13.

Referring to FIG. 13, the analog unit 600 may include a source channel unit 630 and a gamma unit 610. The source channel unit 630 may provide the first current display data CDD1 and the over drive data ODD. The source channel unit 630 may provide the current display voltage VCD and the over drive voltage VOD based on the over drive time ODT. The gamma unit 610 may provide the current display voltage VCD and the over drive voltage VOD to the source channel unit 630. The current display voltage VCD may correspond to the first current display data CDD1 from the source channel unit 630. The over drive voltage VOD may correspond to the over drive data ODD from the source channel unit 630.

Referring to FIG. 14, the source channel unit 630 may include a storage unit 633 and an output unit 631. The storage unit 633 may store the first current display data CDD1 and the over drive data ODD. The output unit 631 may provide the current display voltage VCD and the over drive voltage VOD based on the over drive time ODT. The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Figure 15:
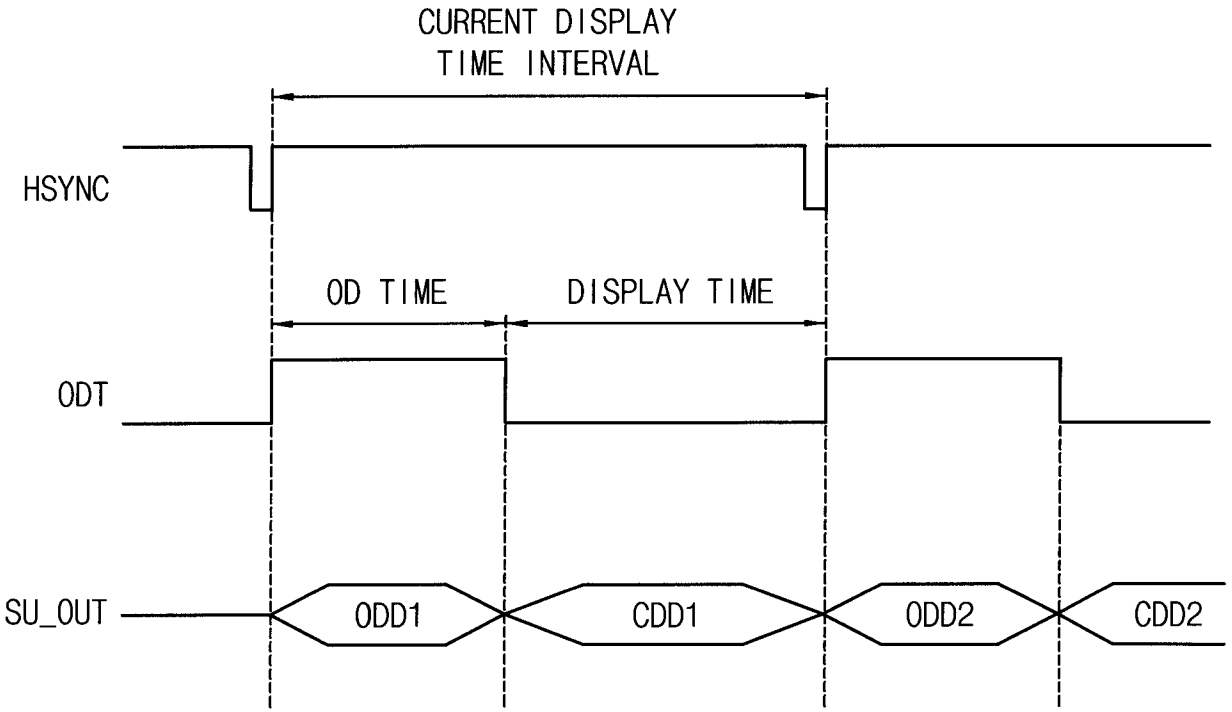
FIG. 15 is a diagram for describing an operation of a storage unit included in the source channel unit of FIG. 14.

FIG. 15 is a diagram for describing an operation of a storage unit included in the source channel unit of FIG. 14.

Referring to FIG. 15, the current display time interval CDTI may include the over drive time ODT and the display time DT. For example, the storage unit 633 may provide the over drive data ODD during a time-interval corresponding to the over drive time ODT. For example, the storage unit 633 may provide the first current display data CDD1 during a time-interval corresponding to a display time DT.

In an exemplary embodiment, a sum of a time-interval corresponding to the over drive time ODT and the time-interval corresponding to the display time DT may be constant. For example, the sum of the time-interval corresponding to the over drive time ODT and the time-interval corresponding to the display time DT may be the current display time interval CDTI.

Figure 16:
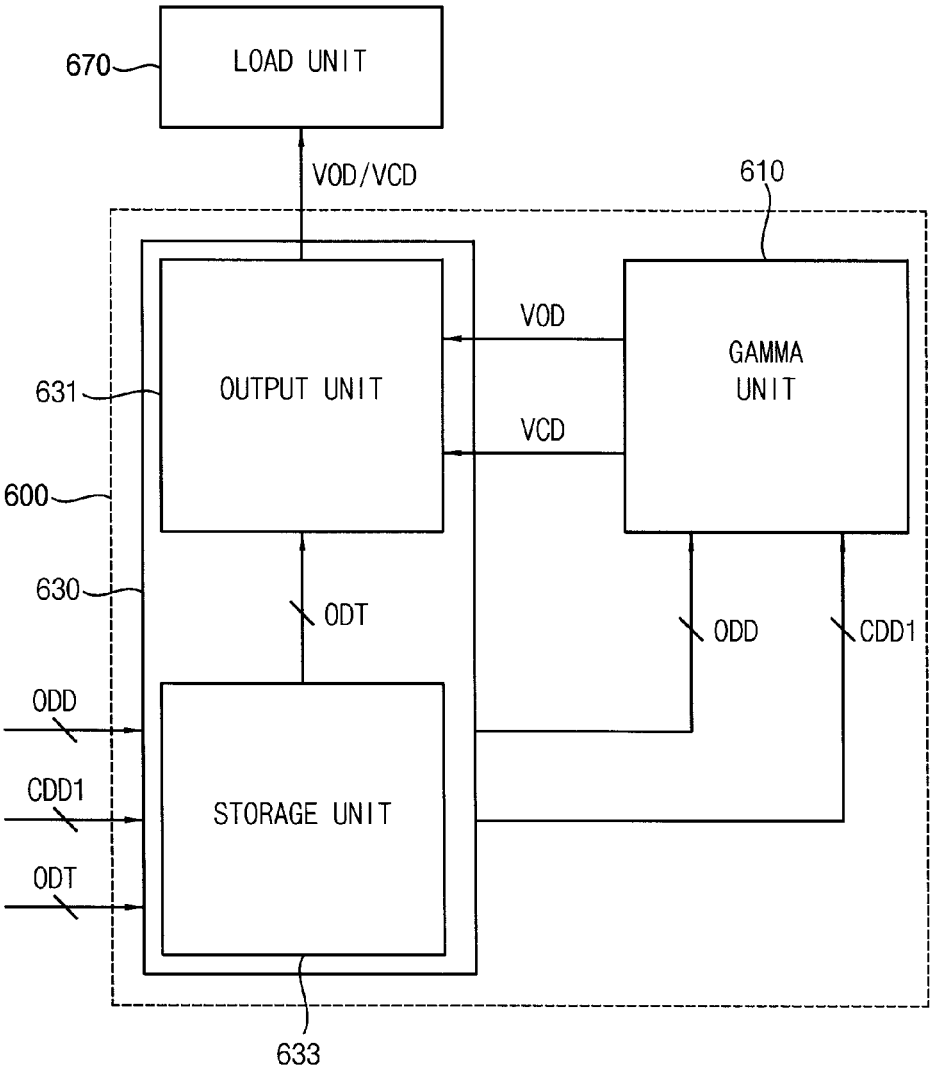
FIG. 16 is a diagram illustrating an example of a load unit connected to an analog unit.

FIG. 16 is a diagram illustrating an example of a load unit connected to an analog unit.

Referring to FIG. 16, the analog unit 600 may include a source channel unit 630 and a gamma unit 610. The source channel unit 630 may provide the first current display data CDD1 and the over drive data ODD. The source channel unit 630 may provide the current display voltage VCD and the over drive voltage VOD based on the over drive time ODT. The gamma unit 610 may provide the current display voltage VCD and the over drive voltage VOD to the source channel unit 630. The current display voltage VCD may correspond to the first current display data CDD1 from the source channel unit 630. The over drive voltage VOD may correspond to the over drive data ODD from the source channel unit 630. The source channel unit 630 may include a storage unit 633 and an output unit 631. The storage unit 633 may store the first current display data CDD1 and the over drive data ODD. The output unit 631 may provide the current display voltage VCD and the over drive voltage VOD based on the over drive time ODT. The load unit 670 may receive the current display voltage VCD and the over drive voltage VOD from the output unit 631 included in the source channel unit 630.

Figure 17:
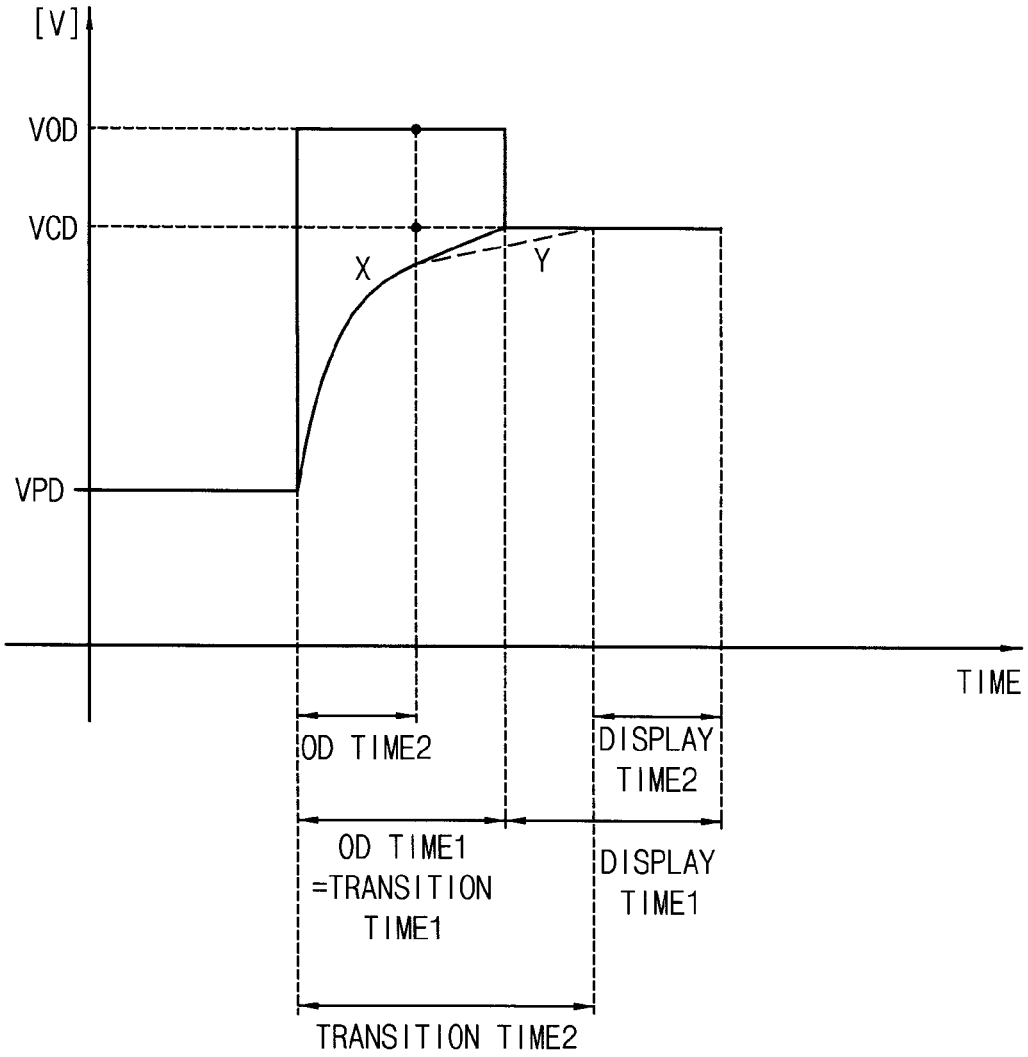
FIG. 17 is a diagram for describing a transition time of a load unit according to an over drive time.

FIG. 17 is a diagram for describing a transition time of a load unit according to an over drive time.

Referring to FIG. 17, after the previous display voltage VPD is applied to the load unit 670 connected to the display driver during the previous display time interval PDTI, the over drive voltage VOD greater than the current display voltage VCD may be applied to the load unit 670 during the over drive time ODT so that the voltage of the load unit 670 maintains the current display voltage VCD during the display time DT included in the current display time interval CDTI.

In an exemplary embodiment, a transition time TT of a load unit 670 may be changed based on the over drive time ODT. The load unit 670 may receive the current display voltage VCD and the over drive voltage VOD from the source channel unit 630. As described referring to FIG. 12, the over drive time ODT may be changed by controlling the over drive time register 500 according to a control signal CS.

For example, the over drive time ODT may be a first over drive time ODT1 or a second over drive time ODT2. The first over drive time ODT1 may be greater than the second over drive time ODT2. The over drive voltage VOD may be applied to the load unit 670 during the first over drive time ODT1. If the over drive voltage VOD is applied to the load unit 670 during the first over drive time ODT1, the voltage of the load unit 670 may be the current display voltage VCD after a first transition time TT1. Also, the over drive voltage VOD may be applied to the load unit 670 during the second over drive time ODT2. If the over drive voltage VOD is applied to the load unit 670 during the second over drive time ODT2, the voltage of the load unit 670 may be the current display voltage VCD after a second transition time TT2.

A transition curve corresponding to the first over drive time ODT1 may be an X curve. A transition curve corresponding to the second over drive time ODT2 may be a Y curve. The first transition time TT1 is less than the second transition time TT2. In other words, the first display time DT1 may be greater than the second display time DT2. Therefore, if the over drive time ODT is increased, the transition time TT may be decreased.

Figure 18:
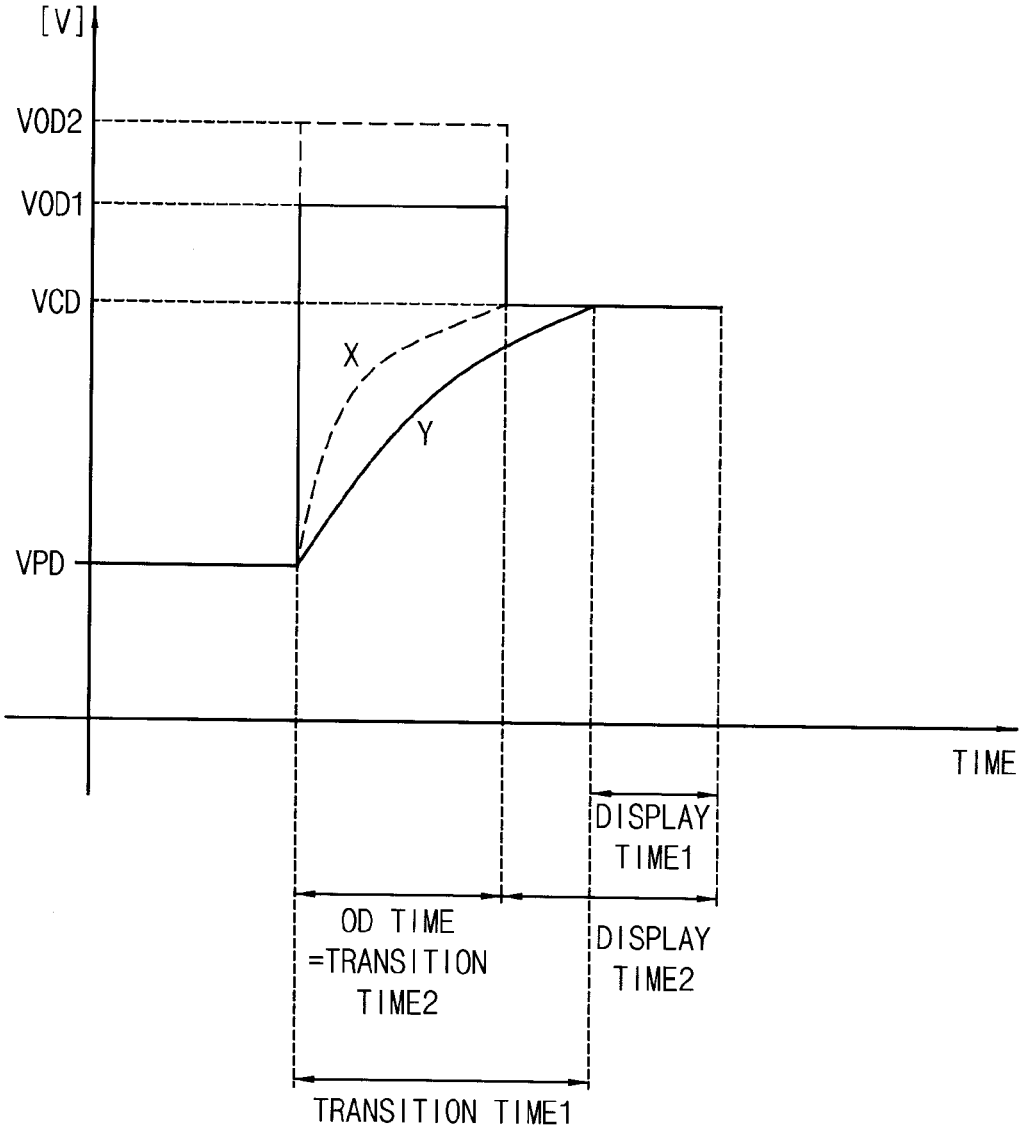
FIG. 18 is a diagram for describing a transition time of a load unit according to an over drive data.

FIG. 18 is a diagram for describing a transition time of a load unit according to an over drive data.

Referring to FIG. 18, after the previous display voltage VPD is applied to the load unit 670 connected to the display driver during the previous display time interval PDTI, the over drive voltage VOD greater than the current display voltage VCD may be applied to the load unit 670 during the over drive time ODT so that the voltage of the load unit 670 maintains the current display voltage VCD during the display time DT included in the current display time interval CDTI.

In an exemplary embodiment, a transition time TT of a load unit 670 may be changed based on the over drive data ODD. The load unit 670 may receive the current display voltage VCD and the over drive voltage VOD from the source channel unit 630.

For example, the over drive voltage VOD may be a first over drive voltage VOD1 or a second over drive voltage VOD2. The first over drive voltage VOD1 may be lower than the second over drive voltage VOD2. The first over drive voltage VOD1 may be applied to the load unit 670 during the over drive time ODT. If the first over drive voltage VOD1 is applied to the load unit 670 during the over drive time ODT, the voltage of the load unit 670 may be the current display voltage VCD after a first transition time TT1. Also, the second over drive voltage VOD2 may be applied to the load unit 670 during the over drive time ODT. If the second over drive voltage VOD2 is applied to the load unit 670 during the over drive time ODT, the voltage of the load unit 670 may be the current display voltage VCD after a second transition time TT2.

A transition curve corresponding to the first over drive voltage VOD1 may be a Y curve. A transition curve corresponding to the second over drive voltage VOD2 may be an X curve. The first transition time TT1 is greater than the second transition time TT2. In other words, the first display time DT1 may be less than the second display time DT2.

Therefore, if the over drive voltage VOD is increased, the transition time TT may be decreased.

In an exemplary embodiment, a highest voltage of the current display voltage VCD may be less than a highest voltage of the over drive voltage VOD. A lowest voltage of the current display voltage VCD is greater than a lowest voltage of the over drive voltage VOD.

Referring to FIGS. 3 and 18, the first current display data CDD1 and the previous display data PDD may be one of R1 to R16. In the case the previous display data PDD is R10 and the first current display data CDD1 is R16, the over drive data ODD may be greater than R16. The over drive data ODD may be VDD. The highest level-value of the first current display data CDD1 may be R16 and the highest level-value of the over drive data ODD may be VDD. The current display voltage VCD corresponding to R16 may be the highest voltage of the current display voltage VCD. The over drive voltage VOD corresponding to VDD may be the highest voltage of the over drive voltage VOD. In this case, to drive the load unit 670 using the over drive voltage VOD, the over drive voltage VOD corresponding to VDD is higher than the current display voltage VCD corresponding to R16.

For example, in the case the previous display data PDD is R10 and the first current display data CDD1 is R1, the over drive data ODD may be less than R1. The over drive data ODD may be GND. The lowest level-value of the first current display data CDD1 may be R1 and the lowest level-value of the over drive data ODD may be GND. The current display voltage VCD corresponding to R1 may be the lowest voltage of the current display voltage VCD. The over drive voltage VOD corresponding to GND may be the lowest voltage of the over drive voltage VOD. In this case, to drive the load unit 670 using the over drive voltage VOD, the over drive voltage VOD corresponding to GND is lower than the current display voltage VCD corresponding to R1.

The data generator 10 according to exemplary embodiments may increase the speed of driving the load connected to a display driver using the over drive voltage VOD corresponding to the over drive data ODD. If the speed of driving the load connected to the display driver is increased, the operation speed of the display device may be increased.

Figure 19:
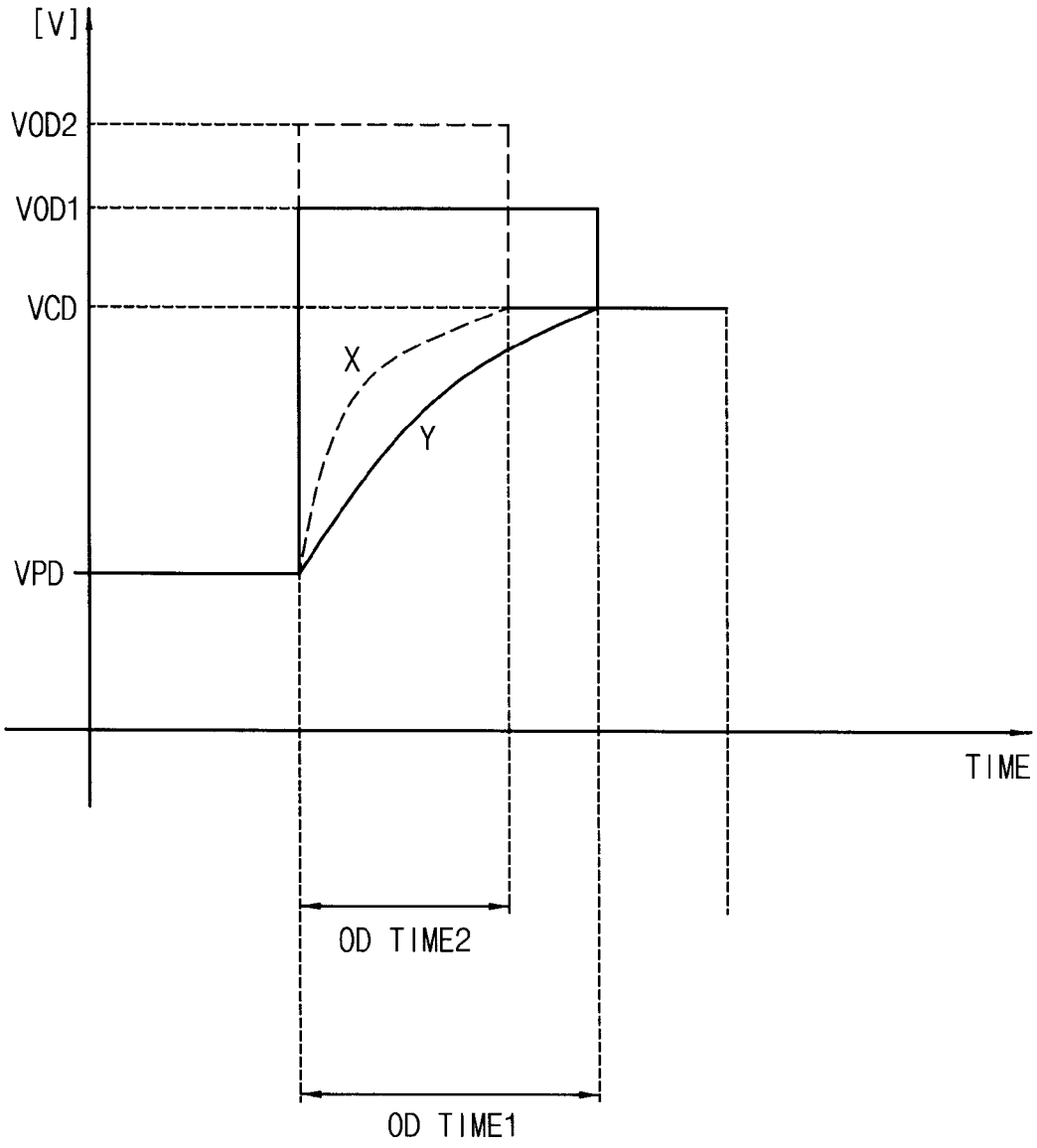
FIG. 19 is a diagram for describing an over drive time of a load unit according to an over drive data.

FIG. 19 is a diagram for describing an over drive time of a load unit according to an over drive data.

Referring to FIG. 19, after the previous display voltage VPD is applied to the load unit 670 connected to the display driver during the previous display time interval PDTI, the over drive time ODT may be controlled according to the over drive data ODD so that the voltage of the load unit 670 maintains the current display voltage VCD during the display time DT included in the current display time interval CDTI. In an exemplary embodiment, the over drive time ODT may be decreased as the over drive data ODD is increased. In other example embodiment, the over drive time ODT may be increased as the over drive data ODD is decreased.

For example, the over drive voltage VOD may be a first over drive voltage VOD1 or a second over drive voltage VOD2. The first over drive voltage VOD1 may be lower than the second over drive voltage VOD2. The first over drive voltage VOD1 may be a voltage corresponding to a first over drive data ODD. The second over drive voltage VOD2 may be a voltage corresponding to a second over drive data ODD. In the case the first over drive voltage VOD1 corresponding to the first over drive data ODD is used, the over drive time ODT may be changed as the first over drive time ODT1. Also, in the case the second over drive voltage VOD2 corresponding to the second over drive data ODD is used, the over drive time ODT may be changed as the second over drive time ODT2. In this case, the first over drive time ODT1 may be greater than the second over drive time ODT2.

Figure 20:
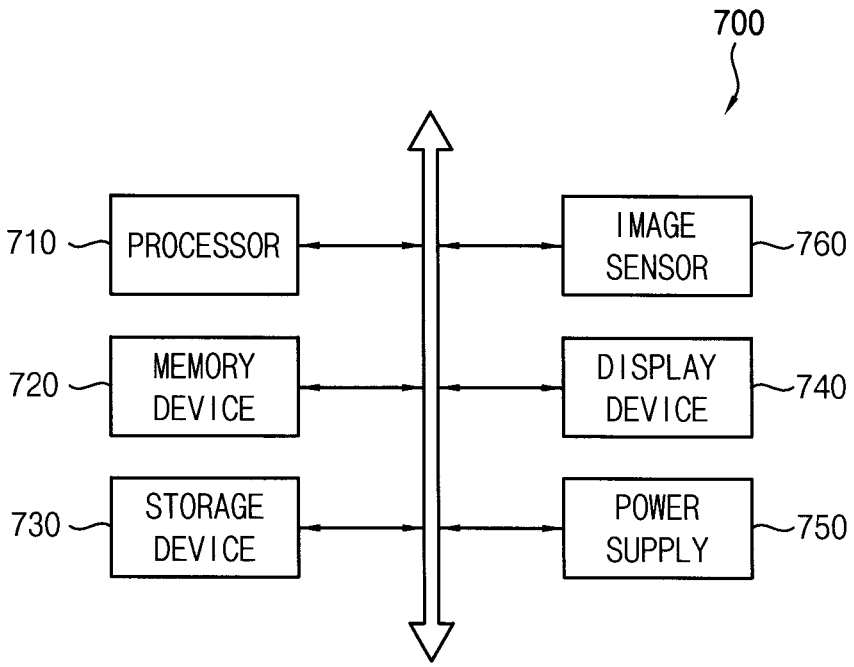
FIG. 20 is a block diagram illustrating a computing system including a display device according to exemplary embodiments.

FIG. 20 is a block diagram illustrating a computing system including the display device according to exemplary embodiments.

Referring to FIG. 20, a computing system 700 may include a processor 710, a memory device 720, a storage device 730, a display device 740, a power supply 750 and an image sensor 760. The computing system 700 may further include ports that communicate with a video card, a sound card, a memory card, a USB device, other electronic devices, etc.

The processor 710 may perform various calculations or tasks. According to embodiments, the processor 710 may be a microprocessor or a CPU. The processor 710 may communicate with the memory device 720, the storage device 730, and the display device 740 via an address bus, a control bus, and/or a data bus. In one or more exemplary embodiments, the processor 710 may be coupled to an extended bus, such as a peripheral component interconnection (PCI) bus. The memory device 720 may store data for operating the computing system 700. For example, the memory device 720 may be implemented with a dynamic random access memory (DRAM) device, a mobile DRAM device, a static random access memory (SRAM) device, a phase-change random access memory (PRAM) device, a ferroelectric random access memory (FRAM) device, a resistive random access memory (RRAM) device, and/or a magnetic random access memory (MRAM) device. The memory device 720 includes the data loading circuit according to exemplary embodiments. The storage device 730 may include a solid state drive (SSD), a hard disk drive (HDD), a CD-ROM, etc. The computing system 700 may further include an input device such as a touchscreen, a keyboard, a keypad, a mouse, etc., and an output device such as a printer, a display device, etc. The power supply 750 supplies operation voltages for the computing system 700. The display device 740 may include a display panel (not shown) and a display driver, as described above with reference to exemplary embodiments. Examples of the display device may include a liquid crystal display (LCD), a plasma display panel (PDP), an organic light emitting diode (OLED) display, a field emission display (FED), a light emitting diode (LED) display, a vacuum fluorescent display (VFD), a digital light processing (DLP) display, a primary flight display (PFD), a three-dimensional (3D) display, a transparent display, and other various display devices.

The image sensor 760 may communicate with the processor 710 via the buses or other communication links. The image sensor 760 may be integrated with the processor 710 in one chip, or the image sensor 760 and the processor 710 may be implemented as separate chips.

At least a portion of the computing system 700 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline IC (SOIC), shrink small outline package (SSOP), thin small outline package (TSOP), system in package (SIP), multi-chip package (MCP), wafer-level fabricated package (WFP), or wafer-level processed stack package (WSP). The computing system 700 may be a digital camera, a mobile phone, a smart phone, a portable multimedia player (PMP), a personal digital assistant (PDA), a computer, etc.

Figure 21:
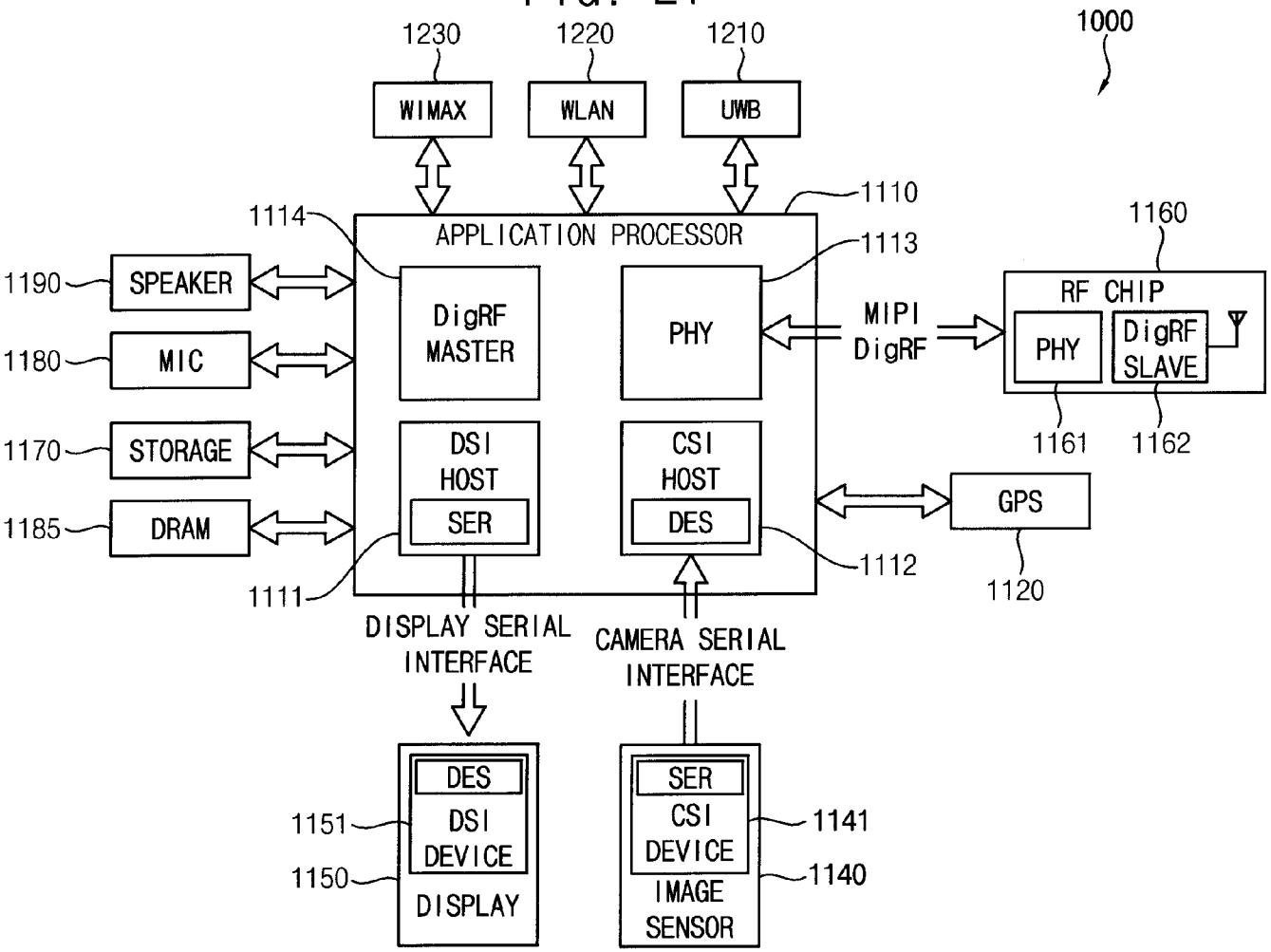
FIG. 21 is a block diagram illustrating an example of an interface used in the computing system of FIG. 20.

FIG. 21 is a block diagram illustrating an example of an interface used in the computing system of FIG. 20.

Referring to FIG. 21, a computing system 1000 may be implemented by a data processing device that uses or supports a mobile industry processor interface (MIPI) interface. The computing system 1000 may include an application processor 1110, an image sensor 1140, a display device 1150, etc. For example, the display device 1150 may include the source driver. A CSI host 1112 of the application processor 1110 may perform a serial communication with a CSI device 1141 of the image sensor 1140 via a camera serial interface (CSI). In one or more exemplary embodiments, the CSI host 1112 may include a deserializer (DES), and the CSI device 1141 may include a serializer (SER). A DSI host 1111 of the application processor 1110 may perform a serial communication with a DSI device 1151 of the display device 1150 via a display serial interface (DSI). For example, the display device 1150 may include a display panel (not shown) and a display driver, as described above with reference to exemplary embodiments. Examples of the display device may include a liquid crystal display (LCD), a plasma display panel (PDP), an organic light emitting diode (OLED) display, a field emission display (FED), a light emitting diode (LED) display, a vacuum fluorescent display (VFD), a digital light processing (DLP) display, a primary flight display (PFD), a three-dimensional (3D) display, a transparent display, and other various display devices.

In one or more exemplary embodiments, the DSI host 1111 may include a serializer (SER), and the DSI device 1151 may include a deserializer (DES). The computing system 1000 may further include a radio frequency (RF) chip 1160 performing a communication with the application processor 1110. A physical layer (PHY) 1113 of the computing system 1000 and a physical layer (PHY) 1161 of the RF chip 1160 may perform data communications based on a MIPI DigRF. The application processor 1110 may further include a DigRF MASTER 1114 that controls the data communications of the PHY 1161.

The computing system 1000 may further include a global positioning system (GPS) 1120, a storage 1170, a MIC 1180, a DRAM device 1185, and a speaker 1190. In addition, the computing system 1000 may perform communications using an ultra-wideband (UWB) 1210, a wireless local area network (WLAN) 1220, a worldwide interoperability for microwave access (WIMAX) 1130, etc. Other structures and interfaces of the electric device 1000 may also be used.

Figure 22:
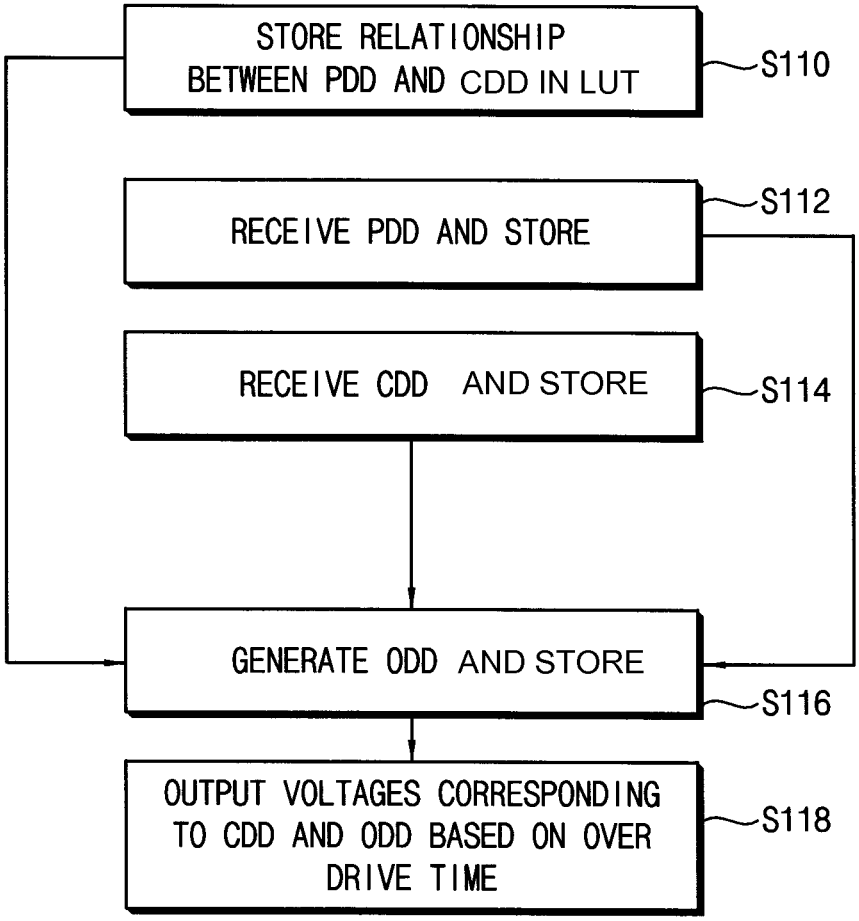
FIG. 22 is a block diagram illustrating a control method according to an exemplary embodiment.

FIG. 22 illustrates a control method according to an exemplary embodiment. The descriptions above are applicable here and repeated descriptions will be omitted.

In operation S110, predetermined values for an over drive data are stored, in a look up table of a memory. The values for the over drive data that are defined based on a relationship of previous display data values and current display data values, in a matrix format.

In operation S112, an input of a previous display data (PDD) is received. The previous display data is stored in the buffer 300.

In operation S114, an input of a current display data (CDD) is received subsequent to the input of the previous display data. The current display data is stored in the buffer 300.

In operation S116, an over drive data is generated by retrieving, from the look up table, the predetermined values of the over drive data. For example, the received current display data and the received previous display data are matched to the previous display data values and the current display data values arranged in a matrix in the look up table and the predetermined values for the over drive data are retrieved in response to matched results.

In operation S118, a current display voltage corresponding to the current display data and an over drive voltage corresponding to the over drive data are output. For example, the current display voltage and the over drive voltage may be generated by the analog unit 600 based on the current display data, the over drive data and the over drive time, as described above.

The foregoing exemplary embodiments and advantages are merely exemplary and are not limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An apparatus comprising:

a processor comprising an over drive data generator configured to generate an over drive data based on a current display data and a previous display data which is received before the current display data is received; and a buffer configured to provide the previous display data to the over drive data generator, store the current display data and the over drive data, and output the current display data and the over drive data;

an over drive time register configured to store an over drive time; and an analog unit configured to provide a current display voltage corresponding to the current display data and an over drive voltage corresponding to the over drive data based on the over drive time, the current display data, and the over drive data, wherein a highest voltage of the current display voltage is less than a highest voltage of the over drive voltage, and a lowest voltage of the current display voltage is greater than a lowest voltage of the over drive voltage.

2. The apparatus of claim 1, wherein the over drive data generator includes a look-up table configured to store the over drive data that is defined in advance in correspondence to previous display data values and current display data values, and the over drive data generator is configured to generate the over drive data corresponding to the received previous display data and the received current display data based on the look-up table.

3. The apparatus of claim 1, wherein the over drive data generator is configured to provide the over drive data of a greater value than that of the current display data in response to the current display data being of a greater value than that of the previous display data.

4. The apparatus of claim 1, wherein the over drive data generator is configured to provide the over drive data of a value equal to that of the current display data, in response to a value of the current display data being equal to that of the previous display data.

5. The apparatus of claim 1, wherein the over drive data generator is configured to provide the over drive data of a smaller value than that of the current display data, in response to the current display data being of a smaller value than that of the previous display data.

6. The apparatus of claim 1, wherein each of the current display data and the previous display data is expressed as a value of a plurality of level-values, and the over drive data generator is configured to stop providing the over drive data, in response to a value of the current display data being equal to that of the previous display data.

7. The apparatus of claim 1, wherein each of the current display data and the previous display data is expressed as a value of a plurality of level-values, and the over drive data generator is configured to stop providing the over drive data, in response to a difference between the current display data value and the previous display data value being a unit level-value.

8. A display driver comprising:

an over drive time register configured to store an over drive time;

a data generator configured to provide a current display data and an over drive data; and an analog unit configured to provide a current display voltage corresponding to the current display data and an over drive voltage corresponding to the over drive data based on the over drive time, the current display data, and the over drive data, the data generator comprising:

an over drive data generator configured to generate the over drive data based on the current display data and a previous display data which is received before the current display data; and a buffer configured to provide the previous display data to the over drive data generator, store the current display data and the over drive data, and output the current display data and the over drive data, wherein a highest voltage of the current display voltage is less than a highest voltage of the over drive voltage, and a lowest voltage of the current display voltage is greater than a lowest voltage of the over drive voltage.

9. The display driver of claim 8, wherein the analog unit includes:

a source channel unit configured to provide the current display data and the over drive data, and the current display voltage and the over drive voltage based on the over drive time; and a gamma unit configured to provide the current display voltage and the over drive voltage to the source channel unit, the current display voltage corresponding to the current display data provided from the source channel unit, and the over drive voltage corresponding to the over drive data provided from the source channel unit.

10. The display driver of claim 9, wherein the source channel unit including:

a storage unit configured to store the current display data and the over drive data; and an output unit configured to provide the current display voltage and the over drive voltage based on the over drive time.

11. The display driver of claim 10, wherein the storage unit is configured to provide the over drive data during a time-interval corresponding to the over drive time.

12. The display driver of claim 10, wherein the storage unit is configured to provide the current display data during a time-interval corresponding to a display time.

13. The display driver of claim 12, wherein a sum of a time-interval corresponding to the over drive time and the time-interval corresponding to the display time is constant.

14. The display driver of claim 9, wherein the source channel unit is configured to provide the current display voltage and the over drive voltage to a load unit, and a transition time of the load unit is changed based on the over drive time.

15. The display driver of claim 9, wherein the source channel unit is configured to provide the current display voltage and the over drive voltage to a load unit, and a transition time of the load unit is changed based on the over drive data.

16. A display apparatus comprising:

a display panel configured to display an image signal; and the display driver of claim 8.

17. A method comprising:

storing, in a look up table of a memory, predetermined values for an over drive data that are defined based on a relationship of previous display data values and current display data values;

receiving an input of a previous display data and, subsequently, of a current display data;

generating an over drive data by retrieving, from the look up table, the predetermined values of the over drive data by matching the received current display data and previous display data to the previous display data values and the current display data values stored in the look up table and retrieving the predetermined values for the over drive data in response to matched results;

storing an over drive time; and outputting a current display voltage corresponding to the current display data and an over drive voltage corresponding to the over drive data to a load unit, based on the over drive time, a value of the current display data, and a value of the over drive data, wherein a highest voltage of the current display voltage is less than a highest voltage of the over drive voltage, and a lowest voltage of the current display voltage is greater than a lowest voltage of the over drive voltage.

18. The method of claim 17, wherein the generating the over drive data comprises:

generating the over drive data of a greater value than that of the current display data in response to the current display data being of a greater value than that of the previous display data;

generating the over drive data of a value equal to that of the current display data, in response to a value of the current display data being equal to that of the previous display data; and generating the over drive data of a smaller value than that of the current display data, in response to the current display data being of a smaller value than that of the previous display data.

* * * * *